US008913095B2

(12) United States Patent
Mindler et al.

(10) Patent No.: US 8,913,095 B2
(45) Date of Patent: Dec. 16, 2014

(54) DUPLEX THERMAL PRINTER WITH PIVOTABLE DIVERTER

(71) Applicant: Kodak Alaris Inc., Rochester, NY (US)

(72) Inventors: Robert F. Mindler, Churchville, NY (US); Alex D. Horvath, Fairport, NY (US); Steven J. Tomanovich, Ruch, NY (US); Richard Salter, Rochester, NY (US); Joseph Anthony Manico, Rochester, NY (US)

(73) Assignee: Kodak Alaris Inc., Rochester, NY (US)

( * ) Notice: Subject to any disclaimer, the term of this patent is extended or adjusted under 35 U.S.C. 154(b) by 0 days.

(21) Appl. No.: 14/070,496

(22) Filed: Nov. 2, 2013

(65) Prior Publication Data

US 2014/0085394 A1 Mar. 27, 2014

Related U.S. Application Data

(63) Continuation-in-part of application No. 13/532,865, filed on Jun. 26, 2012, now Pat. No. 8,599,229, and a continuation-in-part of application No. 13/532,875, filed on Jun. 26, 2012, now Pat. No. 8,599,230.

(60) Provisional application No. 61/867,243, filed on Aug. 19, 2013, provisional application No. 61/867,253, filed on Aug. 19, 2013.

(51) Int. Cl.

| | |
|---|---|
| ***B41J 3/60*** | (2006.01) |
| ***B41J 11/00*** | (2006.01) |
| ***B41J 11/70*** | (2006.01) |
| ***B41J 15/04*** | (2006.01) |
| ***B41J 11/66*** | (2006.01) |
| ***B41J 13/00*** | (2006.01) |

(52) U.S. Cl.

CPC *B41J 11/66* (2013.01); *B41J 15/04* (2013.01); *B41J 13/009* (2013.01); *B41J 13/0045* (2013.01); *B41J 11/70* (2013.01); *B41J 3/60* (2013.01)

USPC ..... 347/174; 347/176

(58) Field of Classification Search

CPC ..... B41J 3/60; B41J 11/0045; B65H 15/00; B65H 2301/333

USPC ..... 347/171, 172, 174, 176, 218, 215, 104

See application file for complete search history.

(56) References Cited

U.S. PATENT DOCUMENTS

| | | | | |
|---|---|---|---|---|
| 8,599,229 | B1 * | 12/2013 | Mindler et al. | 347/174 |
| 8,599,230 | B1 * | 12/2013 | Mindler et al. | 347/174 |
| 8,746,687 | B2 * | 6/2014 | Samoto et al. | 271/186 |
| 8,749,604 | B2 * | 6/2014 | Harris et al. | 347/212 |
| 2014/0055548 | A1 * | 2/2014 | Mindler et al. | 347/217 |

FOREIGN PATENT DOCUMENTS

| | | | | |
|---|---|---|---|---|
| JP | 09-327950 | * 12/1997 | ..... | B41J 13/00 |

OTHER PUBLICATIONS

Computer-generated translation of JP 09-327950, published on Dec. 1997.*

* cited by examiner

*Primary Examiner* — Huan Tran

(74) *Attorney, Agent, or Firm* — Hogan Lovells US LLP

(57) ABSTRACT

A roll-fed duplex thermal printing system, comprising a supply roll of receiver media, a printing path, a reversing path, a pivotable diverter and a cutter positioned between the diverter and the reversing path. When the diverter is in a first position the receiver media is directed from the supply roll, when the diverter is in a second position the receiver media is directed from the supply roll into the reversing path, and when the diverter is in the third position the receiver media is directed from the reversing path into the printing path. During a printing operation, the diverter is sequentially repositioned to feed the receiver media into the printing path where a first side image is printed, into the reversing path where it is cut, and into the printing path again where a second side image is printed.

15 Claims, 21 Drawing Sheets

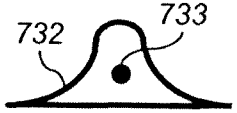
FIG. 13A
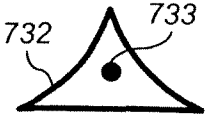
FIG. 13B
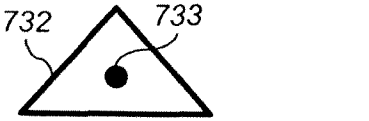
FIG. 13C
FIG. 13D
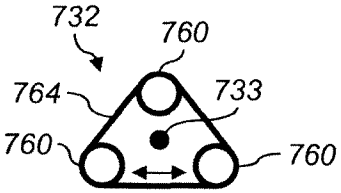
FIG. 13E
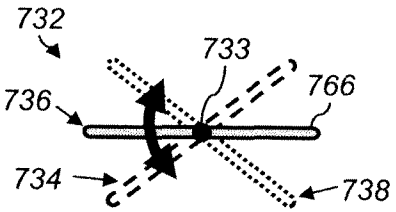
FIG. 13F
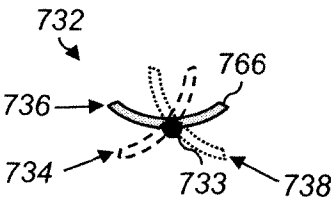
FIG. 13G

DUPLEX THERMAL PRINTER WITH PIVOTABLE DIVERTER

CROSS-REFERENCE TO RELATED APPLICATIONS

This application is a continuation-in-part of U.S. application Ser. No. 13/532,865, filed on Jun. 26, 2012, which is now patented as U.S. Pat No. 8,599,299. This application is also a continuation-in-part of U.S. application Ser. No. 13/532,875, filed on Jun. 26, 2012, which is now patented as U.S. Pat No. 8,599,230. Further, this application is a non-provisional of, and claims priority to, U.S. Provisional Application Numbers 61/867,243 and 61/867,253, which were both filed on Aug 19, 2013. Each of the above-mentioned applications is hereby incorporated by reference in its entirety.

FIELD OF THE INVENTION

This invention pertains to the field of thermal printing systems, and more particularly to a roll-fed thermal printing system that provides duplex images.

BACKGROUND OF THE INVENTION

In thermal dye sublimation printing, it is generally well known to render images by heating and pressing one or more donor materials such as a colorant (e.g., a dye) or other coating against a receiver medium having a colorant receiving layer. The heat is generally supplied by a thermal printhead having an array of heating elements. The donor materials are typically provided in sized donor patches on a movable web known as a donor ribbon. The donor patches are organized on the ribbon into donor sets; each set containing all of the donor patches that are to be used to record an image on the receiver web. For full color images, multiple color dye patches can be used, such as yellow, magenta, and cyan donor dye patches. Arrangements of other color patches can be used in like fashion within a donor set. Additionally, each donor set can include an overcoat or sealant layer.

Thermal printers offer a wide range of advantages in photographic printing including the provision of truly continuous tone scale variation and the ability to deposit, as a part of the printing process a protective overcoat layer to protect the images formed thereby from mechanical and environmental damage. Accordingly, many photographic kiosks and home photo printers currently use thermal printing technology.

Some thermal printing systems are adapted to print on individual sheets of receiver media. Thermal printing systems that are used for large volume applications (e.g., photographic kiosks) commonly utilize roll-fed receiver media. This minimizes the amount of interaction required by a human operator and increases system robustness.

Conventionally, thermal printers have been adapted for producing single-sided images and have used receiver media having a colorant receiving layer coated on only one side of a substrate. There are a variety of applications (e.g., photo books and photo calendars) where it is desirable to print on both sides of the receiver media to provide double-sided images. Some prior art approaches have utilized two printing stations, each including its own thermal printhead and donor ribbon, one to print each side of the image. This adds significant cost and size to the thermal printer design. Other prior art approaches have utilized large and cumbersome mechanisms to reposition the receiver media supply roll after the first-side image has been printed in order to print the second-side image. This approach also adds significant cost and size to the thermal printer design.

There remains a need for roll-fed, duplex thermal printer that is low-cost and compact.

SUMMARY OF THE INVENTION

The present invention represents a roll-fed duplex thermal printing system, comprising:

a supply roll of thermal imaging receiver having dye receiving layers on first and second sides of a substrate;

a printing path;

a reversing path;

a diverter pivotable around an axis into a first position, a second position and a third position, wherein when the diverter is in the first position thermal imaging receiver is directed from the supply roll into the printing path, when the diverter is in the second position the thermal imaging receiver is directed from the supply roll into the reversing path, and when the diverter is in the third position the thermal imaging receiver is directed from the reversing path into the printing path;

a thermal printhead positioned along the printing path;

a donor ribbon feeding from a donor supply roll past the thermal printhead to a donor take-up roll;

a cutter positioned between the diverter and the reversing path; and a printer controller that controls components of the thermal printing system to perform the following sequence of operations:

positioning the diverter into the first position;

feeding the thermal imaging receiver from the supply roll into the printing path such that the first side of the thermal imaging receiver is oriented to face the thermal printhead;

moving the thermal imaging receiver and the donor ribbon past the thermal printhead, during which time the thermal printhead applies heat pulses to transfer colorant from the donor ribbon onto the first side of the thermal imaging receiver, thereby printing a first-side image;

winding the thermal imaging receiver back onto the supply roll;

pivoting the diverter around the axis to reposition it into the second position;

feeding the thermal imaging receiver from the supply roll into the reversing path;

using the cutter to cut a portion of the thermal imaging receiver including the printed first-side image from the supply roll;

winding the uncut portion of the thermal imaging receiver back onto the supply roll;

pivoting the diverter around the axis to reposition it into the third position;

feeding the cut thermal imaging receiver into the printing path such that the second side of the thermal imaging receiver is oriented to face the thermal printhead;

moving the cut thermal imaging receiver and the donor ribbon past the thermal printhead, during which time the thermal printhead applies heat pulses to transfer colorant from a donor ribbon onto the second side of the thermal imaging receiver, thereby printing a second-side image; and feeding the cut thermal imaging receiver out of the printing system.

In some embodiments, the cutter is used to trim one or more end portions off the cut thermal imaging receiver after the first- and second-side images have been printed.

This invention has the advantage that it has a reduced cost relative to duplex printing system that use two thermal printheads or a complex turning mechanism for repositioning the supply roll of thermal imaging receiver.

It has the additional advantage that arc-shaped printing and reversing paths can be used to provide a reduced printer size.

It has the further advantage that a single cutter can be used to both cut the thermal imaging medium and to trim the cut thermal imaging medium, thereby saving the cost of a second cutter mechanism.

BRIEF DESCRIPTION OF THE DRAWINGS

FIGS. 13A-13G illustrate a number of different diverter configurations.

It is to be understood that the attached drawings are for purposes of illustrating the concepts of the invention and may not be to scale.

DETAILED DESCRIPTION OF THE INVENTION

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

Figure 1:
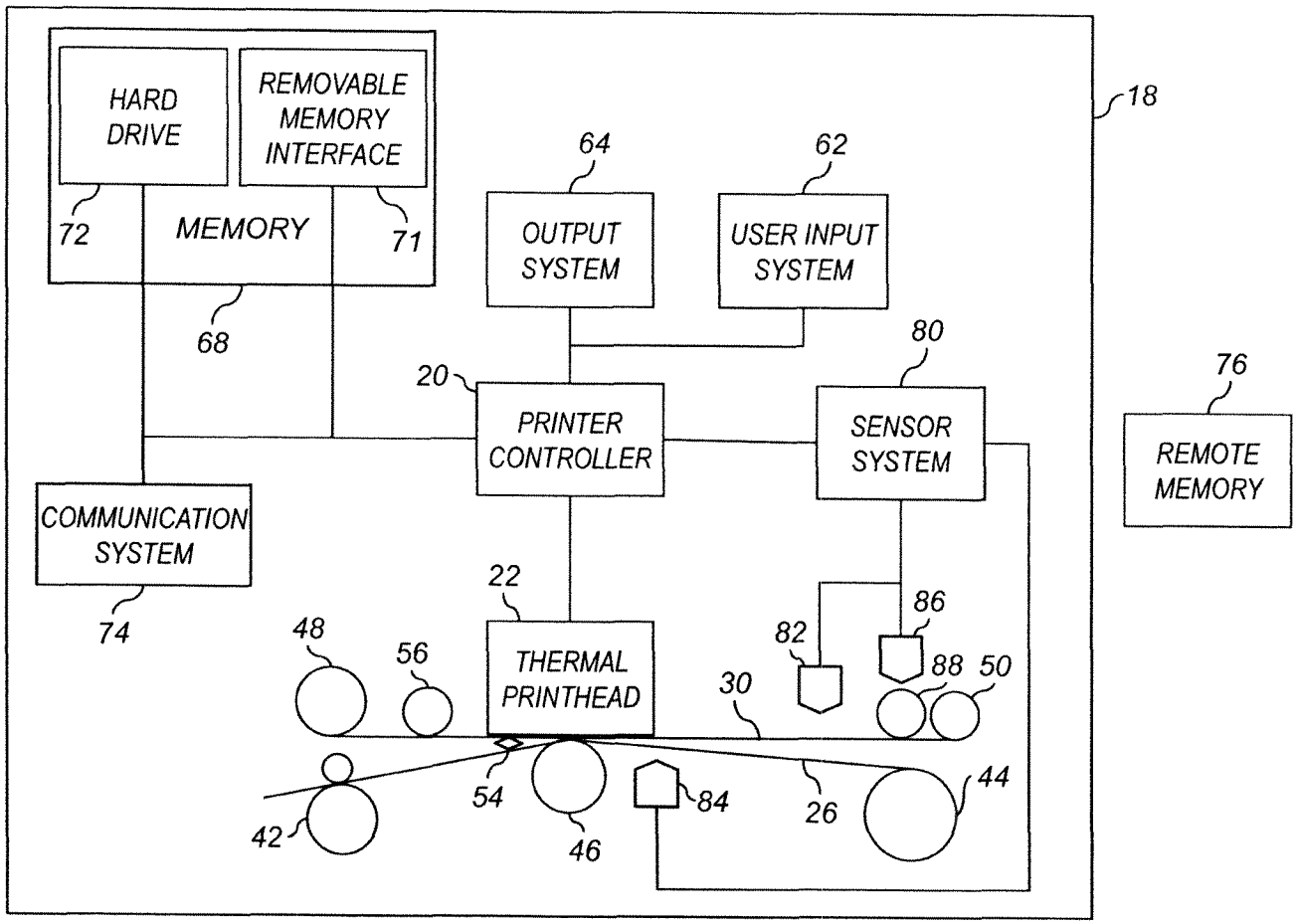
FIG. 1 shows a system diagram for an exemplary thermal printing system.

FIG. 1 shows a system diagram for an exemplary thermal printer 18 in accordance with the present invention. As shown in FIG. 1, thermal printer 18 has a printer controller 20 that causes a thermal printhead 22 to record images onto receiver media 26 by applying heat and pressure to transfer material from a donor ribbon 30 to receiver media 26. The receiver media 26 includes a dye receiving layer coated on a substrate. As used herein, the term "receiver media" is used synonymously with the terms "thermal imaging receiver" and "thermal media." Similarly, the term "donor ribbon" is used synonymously with the terms "thermal donor" and "donor web."

Printer controller 20 can include, but is not limited to: a programmable digital computer, a programmable microprocessor, a programmable logic controller, a series of electronic circuits, a series of electronic circuits reduced to the form of an integrated circuit, or a series of discrete components. In the embodiment of FIG. 1, printer controller 20 also controls a receiver drive roller 42, a receiver supply roll 44, a donor ribbon take-up roll 48, and a donor ribbon supply roll 50; which are each motorized for rotation on command of the printer controller 20 to effect movement of receiver media 26 and donor ribbon 30.

Figure 2:
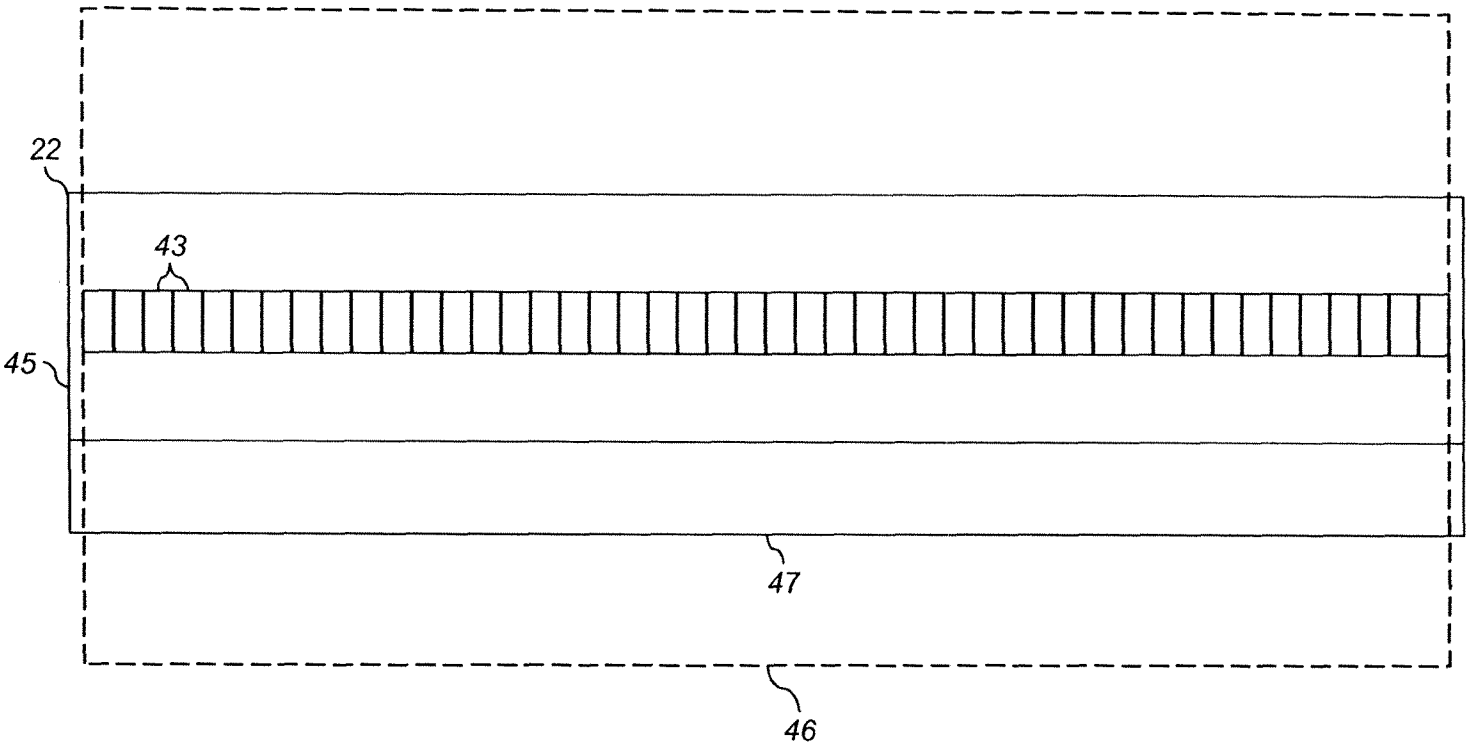
FIG. 2 is a diagram showing a bottom view of a thermal printhead.

FIG. 2 shows a bottom view of one embodiment of a typical thermal printhead 22 with an array of thermal resistors 43 fabricated in a ceramic substrate 45. A heat sink 47, typically in the form of an aluminum backing plate, is fixed to a side of the ceramic substrate 45. Heat sink 47 rapidly dissipates heat generated by the thermal resistors 43 during printing. In the embodiment shown in FIG. 2, the thermal resistors 43 are arranged in a linear array extending across the width of platen roller 46 (shown in phantom). Such a linear arrangement of thermal resistors 43 is commonly known as a heat line or print line. However, other non-linear arrangements of thermal resistors 43 can be used in various embodiments. Further, it will be appreciated that there are a wide variety of other arrangements of thermal resistors 43 and thermal printheads 22 that can be used in conjunction with the present invention.

The thermal resistors 43 are adapted to generate heat in proportion to an amount of electrical energy that passes through thermal resistors 43. During printing, printer controller 20 transmits signals to a circuit board (not shown) to which thermal resistors 43 are connected, causing different amounts of electrical energy to be applied to thermal resistors 43 so as to selectively heat donor ribbon 30 in a manner that is intended to cause donor material to be applied to receiver media 26 in a desired manner.

Figure 3A:
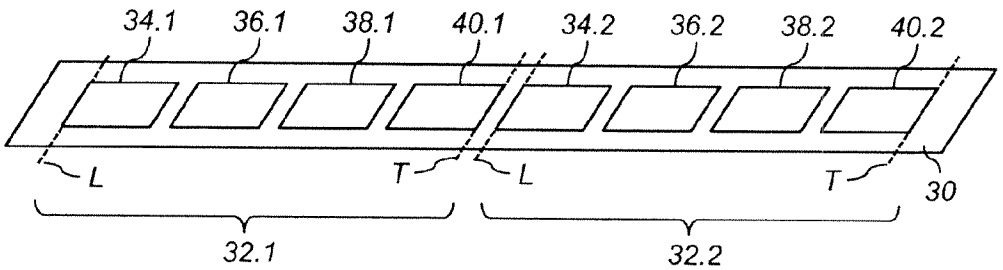
FIG. 3A is a diagram illustrating a donor ribbon having four different donor patches.
Figure 3B:
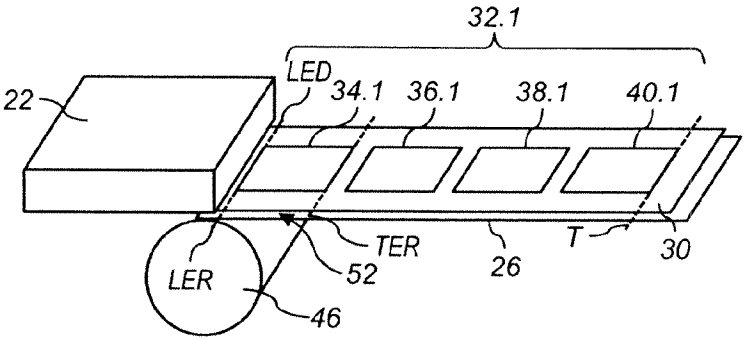
FIGS. 3B-3C illustrate a printing operation.

As is shown in FIG. 3A, donor ribbon 30 comprises a first donor patch set 32.1 having a yellow donor patch 34.1, a magenta donor patch 36.1, a cyan donor patch 38.1 and a clear donor patch 40.1; and a second donor patch set 32.2 having a yellow donor patch 34.2, a magenta donor patch 36.2, a cyan donor patch 38.2 and a clear donor patch 40.2. Each donor patch set 32.1 and 32.2 has a patch set leading edge L and a patch set trailing edge T. In order to provide a full color image with a clear protective coating, the four patches of a donor patch set; are printed, in registration with each other, onto a common image receiving area 52 of receiver media 26 shown in FIG. 3B. The printer controller 20 (FIG. 1) provides variable electrical signals in accordance with input image data to the thermal resistors 43 (FIG. 2) in the thermal printhead 22 in order to print an image onto the receiver media 26. Each color is successively printed as the receiver media 26 and the donor ribbon move from right to left as seen by the viewer in FIG. 3B.

During printing, the printer controller 20 raises thermal printhead 22 and actuates donor ribbon supply roll 50 (FIG. 1) and donor ribbon take-up roll 48 (FIG. 1) to advance a leading edge L of the first donor patch set 32.1 to the thermal printhead 22. In the embodiment illustrated in FIGS. 3A-3C, leading edge L for first donor patch set 32.1 is the leading edge of yellow donor patch 34.1. As will be discussed in greater detail below, the position of this leading edge L can be determined by using a position sensor to detect an appropriate marking indicia on donor ribbon 30 that has a known position relative to the leading edge of yellow donor patch 34.1 or by directly detecting the leading edge of yellow donor patch 34.1.

Printer controller 20 also actuates receiver drive roller 42 (FIG. 1) and receiver supply roll 44 (FIG. 1) so that image receiving area 52 of receiver media 26 is positioned with respect to the thermal printhead 22. In the embodiment illustrated, image receiving area 52 is defined by a receiving area leading edge LER and a receiving area trailing edge TER on receiver media 26. Donor ribbon 30 and receiver media 26 are positioned so that donor patch leading edge LED of yellow donor patch 34.1 is registered at thermal printhead 22 with receiving area leading edge LER of image receiving area 52. Printer controller 20 then causes a motor or other conventional structure (not shown) to lower thermal printhead 22 so that a lower surface of donor ribbon 30 engages receiver media 26 which is supported by platen roller 46. This creates a pressure holding donor ribbon 30 against receiver media 26.

Printer controller 20 then actuates receiver drive roller 42 (FIG. 1), receiver supply roll 44 (FIG. 1), donor ribbon take-up roll 48 (FIG. 1), and donor ribbon supply roll 50 (FIG. 1) to move receiver media 26 and donor ribbon 30 together past the thermal printhead 22. Concurrently, printer controller 20 selectively operates thermal resistors 43 (FIG. 2) in thermal printhead 22 to transfer donor material from yellow donor patch 34.1 to receiver media 26.

Figure 3C:
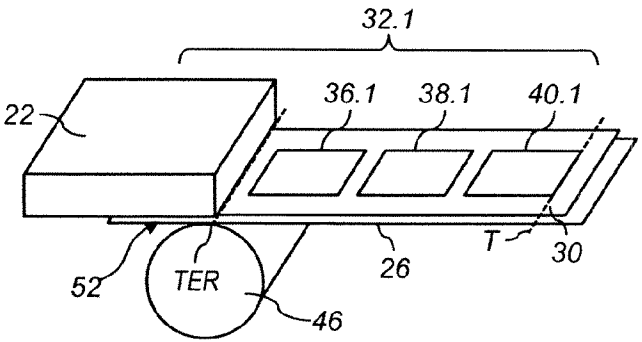

As donor ribbon 30 and receiver media 26 leave the thermal printhead 22, a peel member 54 (FIG. 1) separates donor ribbon 30 from receiver media 26. Donor ribbon 30 continues over idler roller 56 (FIG. 1) toward the donor ribbon take-up roll 48. As shown in FIG. 3C, printing continues until the receiving area trailing edge TER of image receiving area 52 of receiver media 26 reaches the printing zone between the thermal printhead 22 and the platen roller 46. The printer controller 20 then adjusts the position of donor ribbon 30 and receiver media 26 using a predefined pattern of movements so that a leading edge of each of the next donor patches (i.e., magenta donor patch 36.1) in the first donor patch set 32.1 are brought into alignment with receiving area leading edge LER of image receiving area 52 and the printing process is repeated to transfer further material to the image receiving area 52. This process is repeated for each donor patch thereby forming the complete image.

Returning to a discussion of FIG. 1, the printer controller 20 operates the thermal printer 18 based upon input signals from a user input system 62, an output system 64, a memory 68, a communication system 74, and sensor system 80. The user input system 62 can comprise any form of transducer or other device capable of receiving an input from a user and converting this input into a form that can be used by printer controller 20. For example, user input system 62 can comprise a touch screen input, a touch pad input, a 4-way switch, a 6-way switch, an 8-way switch, a stylus system, a trackball system, a joystick system, a voice recognition system, a gesture recognition system or other such user input systems. An output system 64, such as a display or a speaker, is optionally provided and can be used by printer controller 20 to provide human perceptible signals (e.g., visual or audio signals) for feedback, informational or other purposes.

Data including, but not limited to, control programs, digital images and metadata can also be stored in memory 68. Memory 68 can take many forms and can include without limitation conventional memory devices including solid state, magnetic, optical or other data storage devices. In the embodiment of FIG. 1, memory 68 is shown having a removable memory interface 71 for communicating with removable memory (not shown) such as a magnetic, optical or magnetic disks. The memory 68 is also shown having a hard drive 72 that is fixed with thermal printer 18 and a remote memory 76 that is external to printer controller 20 such as a personal computer, computer network or other imaging system.

In the embodiment shown in FIG. 1, printer controller 20 interfaces with a communication system 74 for communicating external devices such as remote memory 76. The communication system 74 can include for example, a wired or wireless network interface that can be used to receive digital image data and other information and instructions from a host computer or network (not shown).

A sensor system 80 includes circuits and systems that are adapted to detect conditions within thermal printer 18 and, optionally, in the environment surrounding thermal printer 18, and to convert this information into a form that can be used by the printer controller 20 in governing printing operations. Sensor system 80 can take a wide variety of forms depending on the type of media therein and the operating environment in which thermal printer 18 is to be used.

In the embodiment of FIG. 1, sensor system 80 includes an optional donor position sensor 82 that is adapted to detect the position of donor ribbon 30, and a receiver position sensor 84 that is adapted to detect a position of the receiver media 26. The printer controller 20 cooperates with donor position sensor 82 to monitor the donor ribbon 30 during movement thereof so that the printer controller 20 can detect one or more conditions on donor ribbon 30 that indicate a leading edge of a donor patch set. In this regard, the donor ribbon 30 can be provided with markings or other optically, magnetically or electronically sensible indicia between each donor patch set (e.g., donor patch set 32.1) or between donor patches (e.g., donor patches 34.1, 36.1, 38.1, and 40.1). Where such markings or indicia are provided, donor position sensor 82 is provided to sense these markings or indicia, and to provide signals to controller 20. The printer controller 20 can use these markings and indicia to determine when the donor ribbon 30 is positioned with the leading edge of the donor patch set at thermal printhead 22. In a similar way, printer controller 20 can use signals from receiver position sensor 84 to monitor the position of the receiver media 26 to align receiver media 26 during printing. Receiver position sensor 84 can be adapted to sense markings or other optically, magnetically or electronically sensible indicia between each image receiving area of receiver media 26.

During a full image printing operation, the printer controller 20 causes donor ribbon 30 to be advanced in a predetermined pattern of distances so as to cause a leading edge of each of the donor patches (e.g., donor patches 34.1, 36.1, 38.1, and 40.1) to be properly positioned relative to the image receiving area 52 at the start each printing process. The printer controller 20 can optionally be adapted to achieve such positioning by precise control of the movement of donor ribbon 30 using a stepper type motor for motorizing donor ribbon take-up roll 48 or donor ribbon supply roll 50 or by using a movement sensor 86 that can detect movement of donor ribbon 30. In one example, a follower wheel 88 is provided that engages donor ribbon 30 and moves therewith. Follower wheel 88 can have surface features that are optically, magnetically or electronically sensed by the movement sensor 86. In one embodiment, the follower wheel 88 that has markings thereon indicative of an extent of movement of donor ribbon 30 and the movement sensor 86 includes a light sensor that can sense light reflected by the markings. In other optional embodiments, perforations, cutouts or other routine and detectable indicia can be incorporated onto donor ribbon 30 in a manner that enables the movement sensor 86 to provide an indication of the extent of movement of the donor ribbon 30.

Optionally, donor position sensor 82 can be adapted to sense the color of donor patches on donor ribbon 30 and can provide color signals to controller 20. In this case, the printer controller 20 can be programmed or otherwise adapted to detect a color that is known to be found in the first donor patch in a donor patch set (e.g., yellow donor patch 34.1 in donor patch set 21.1). When the color is detected, the printer controller 20 can determine that the donor ribbon 30 is positioned proximate to the start of the donor patch set.

Figure 4:
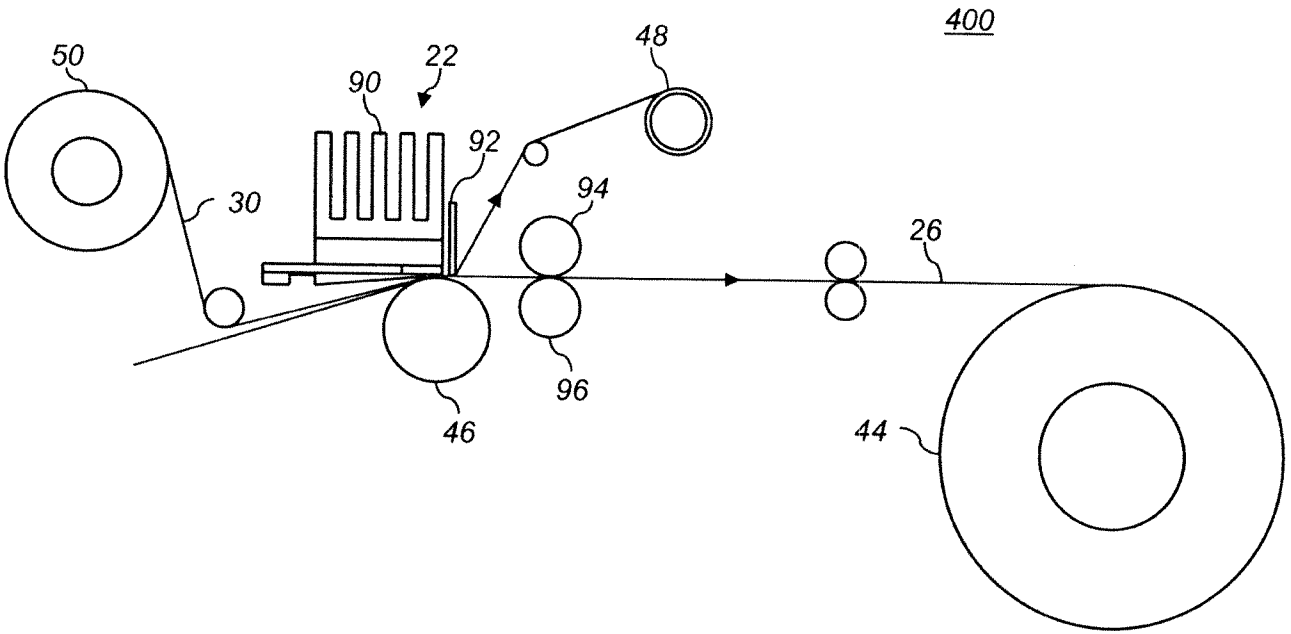
FIG. 4 is a diagram illustrating components of a thermal printing system.

A schematic showing additional details for components of a thermal printing system 400 according to one embodiment is shown in FIG. 4. Donor ribbon supply roll 50 supplies donor ribbon 30. Donor ribbon take-up roll 48 receives the used donor ribbon 30. A receiver supply roll 44 supplies receiver media 26. Receiver media 26 and donor ribbon 30 are merged together between platen roller 46 thermal printhead 22, which includes a heat sink 90 and a peel member 92. Subsequent to the thermal printhead 22 transferring donor material from the donor ribbon 30 to the receiver media 26, the peel member 92 separates the donor ribbon 30 from the receiver media 26. The donor ribbon 30 continues to travel on to the donor ribbon take-up roll 48, while the receiver media 26 travels between a pinch roller 94 and a micro-grip roller 96 that form a nip.

There are many applications where it is desirable to print images on both sides of the receiver media 26. For example, photo calendars and photo book pages generally have photographs or other content (e.g., text and graphics) printed on both sides of each page. To print duplex thermal prints, the receiver media 26 should have dye receiving layers coated on both sides of a substrate. Various arrangements can then be used to transfer dye onto both sides of the receiver media 26.

Figure 5:
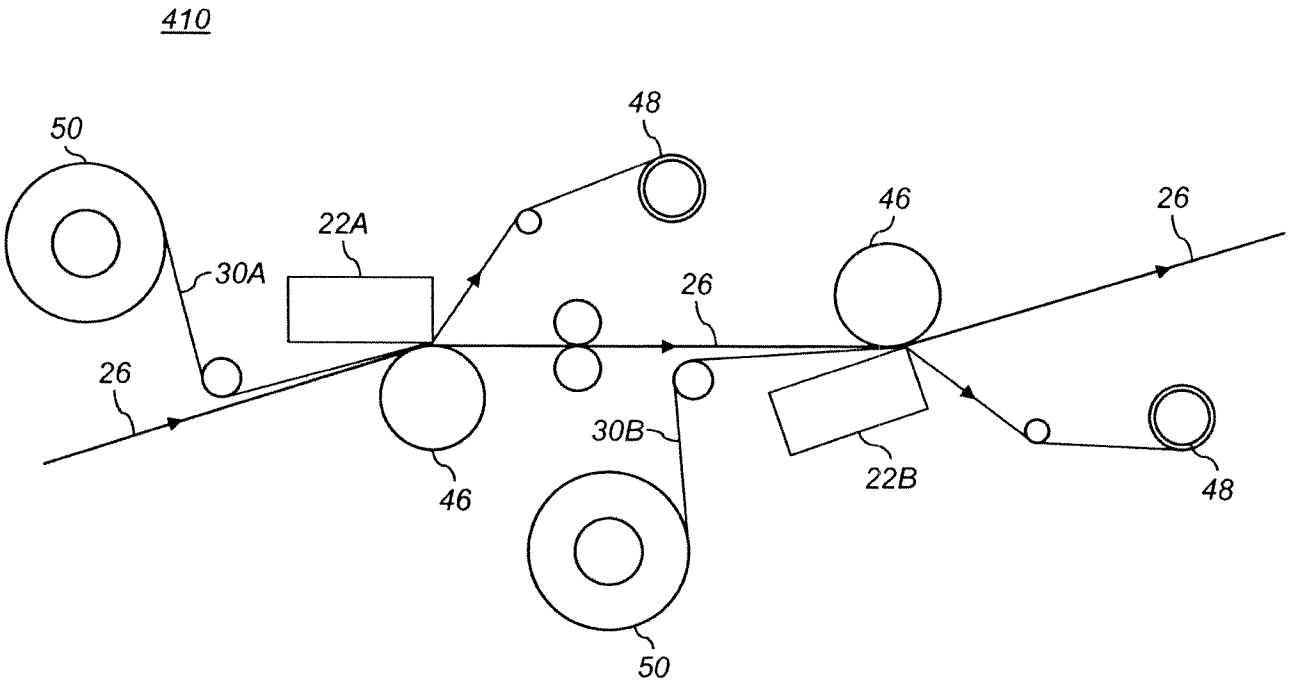
FIG. 5 is a diagram illustrating a duplex thermal printing system using two thermal printheads.

FIG. 5 shows one arrangement that can be used for a duplex thermal printing system 410. In this configuration, the main printing components shown in the arrangement of FIG. 4 are duplicated, with one being arranged to print on each side of the receiver media 26. A first thermal printhead 22A transfers dye from a first donor ribbon 30A onto a first side of the receiver media 26, and a second thermal printhead 22B transfers dye from a second donor ribbon 30B onto a second side of the receiver media 26. This configuration has the advantage that two-sided images can be printed without complex paper handling mechanism. The main disadvantage of this approach is that it adds significant cost to the printer since it doubles the number of thermal printheads 22A and 22B and other associated components. It also requires a longer media path, and therefore increases the printer size accordingly. Another disadvantage is that two rolls of donor ribbon 30A and 30B must be used, which means that the printer operator will need to stock larger numbers of rolls, and if the donor ribbons 30A and 30B are used at different rates they may need to service the printer more frequently to reload donor ribbon when one of the rolls is used up.

Figure 6:
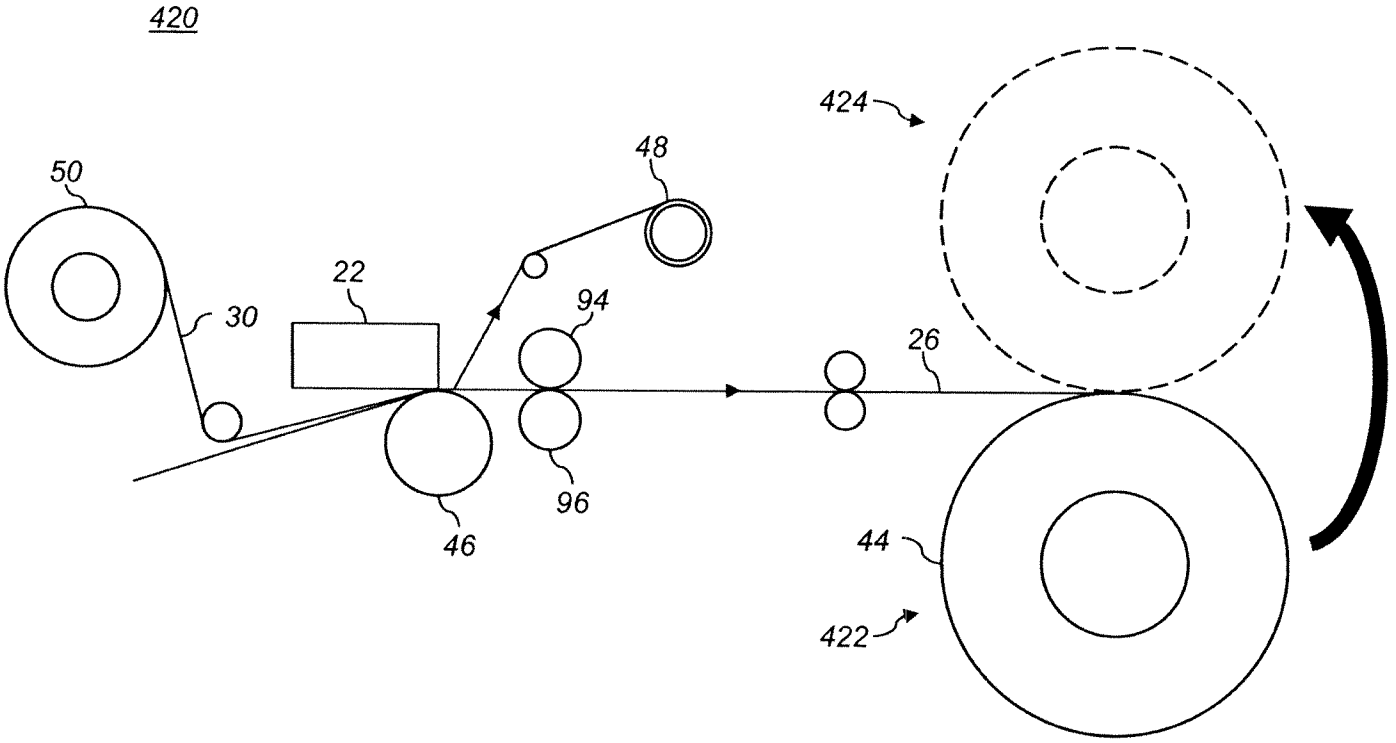
FIG. 6 is a diagram illustrating an alternate duplex thermal printing system that includes a turning mechanism for repositioning the receiver supply roll.

FIG. 6 shows another arrangement that can be used for a duplex thermal printing system 420. In this configuration, which is similar to that used in the KODAK D4000 Duplex Photo Printer, the receiver supply roll 44 is provided with a turning mechanism (not shown) that enables it to be pivoted from a first position 422 to a second position 424. When the receiver supply roll 44 is in the first position 422, the printing system configuration is analogous to that shown in FIG. 4. After the first side of the image has been printed using the thermal printhead, the receiver media 26 is wound back onto the receiver supply roll 44. The receiver supply roll 44 is then pivoted into the second position 424 and the receiver media 26 is rethreaded between the thermal printhead 22 and the platen roller 46. The opposite side of the receiver media will now be facing the thermal printhead 22 so that the second side of the image can be printed. The main disadvantage of this approach is that the turning mechanism for the receiver supply roll 44 adds significant cost to the printer. Since the receiver supply roll 44 is typically quite large relative to the size of the printer, the printer size must also be increased to provide space to position the receiver supply roll 44 into the second position 424.

Figure 7:
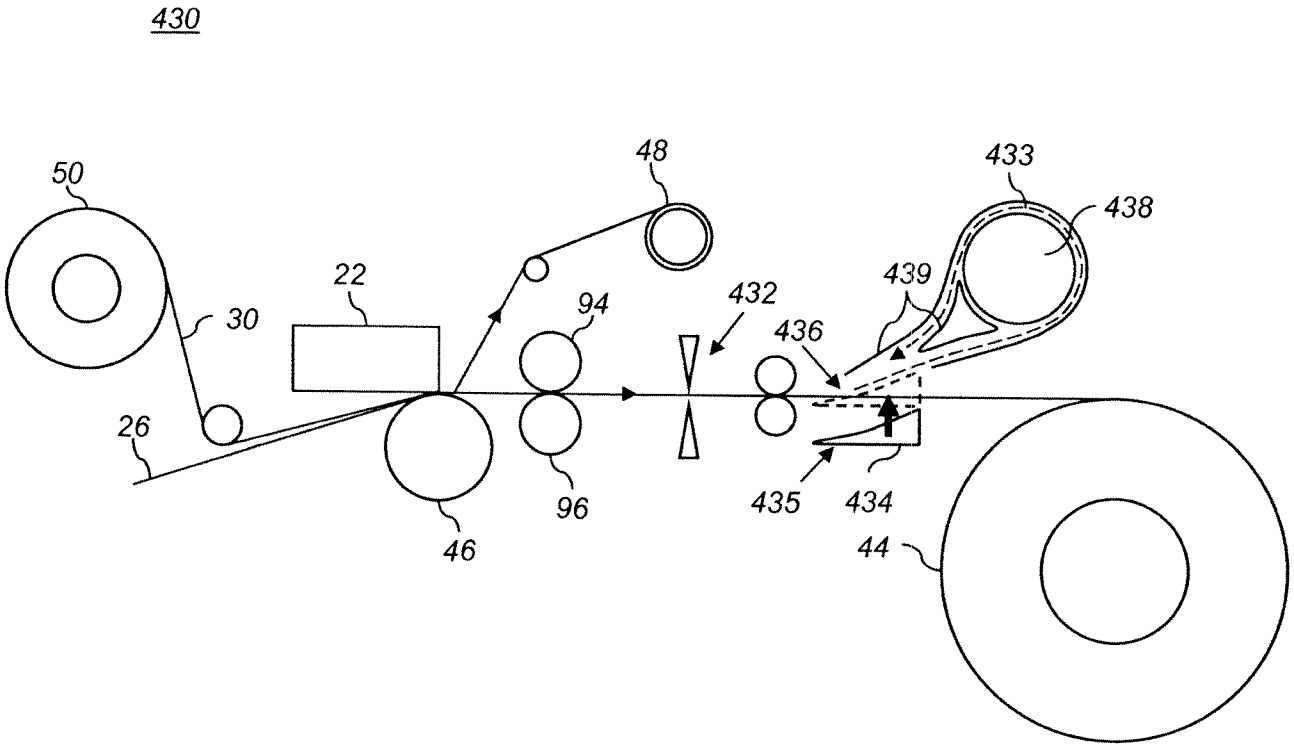
FIG. 7 is a diagram illustrating an alternate duplex thermal printing system using a turn roller.

FIG. 7 shows an embodiment of a duplex thermal printing system 430 that includes a turning mechanism for turning over the receiver media 26. In this configuration a cutter 432 is provided that can be used to cut the receiver media 26 after the first side of the image has been printed. A diverter 434 is then repositioned from a first position 435 to a second position 436 in order to feed cut receiver media 433 into the turning mechanism that includes a turn roller 438 and guides 439. The cut receiver media 433 is then rethreaded between the thermal printhead 22 and the platen roller 46 where the opposite side of the cut receiver media 433 will now be facing the thermal printhead 22 so that the second side of the image can be printed. To keep the size of the printer as small as possible, it is desirable for the turn roller 438 to have a relatively small radius. However, if it is made too small it can have the undesirable affect of introducing curl into the cut receiver media 433 and creating scratches and other undesirable markings on the printed surface.

Figure 8:
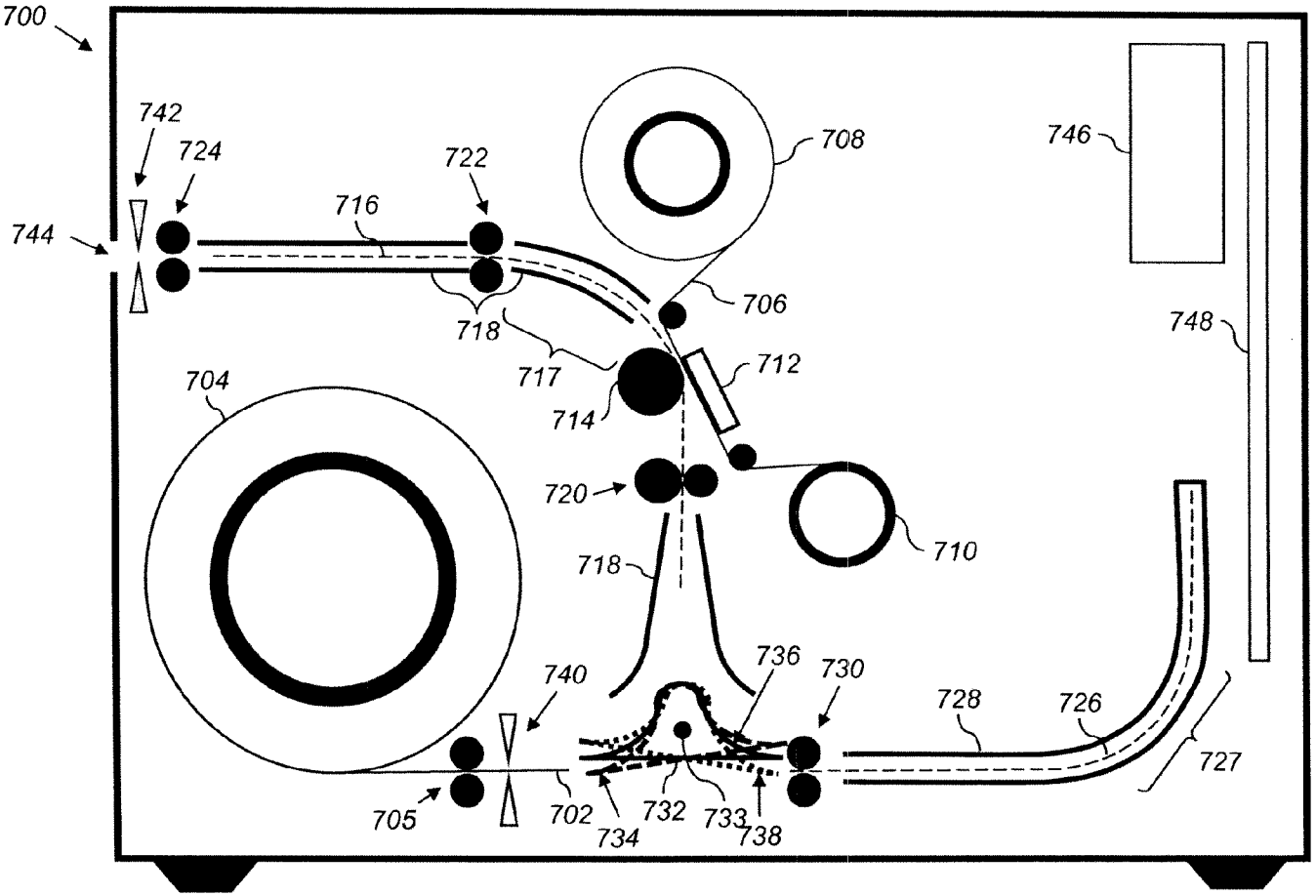
FIG. 8 is a diagram illustrating a duplex thermal printing system according to a preferred embodiment.

FIG. 8 shows a diagram illustrating a duplex thermal printer 700 according to a preferred embodiment. A receiver media 702 is supplied from a receiver supply roll 704. Supply feed rollers 705 are used to feed the receiver media 702 off from the receiver supply roll 704. The receiver media 702 is a thermal imaging receiver that has dye receiving layers coated on first and second sides of a substrate in order to enable duplex printing.

Two different media paths are provided in the printer: a printing path 716 and a reversing path 726. The printing path 716 feeds the receiver media 702 between a thermal printhead 712 and a platen roller 714 in order to print an image by selectively activating thermal resistors 43 (FIG. 2) to transfer dye from a donor ribbon 706 to the receiver media 702. The donor ribbon 706 is supplied by a donor ribbon supply roll 708 and the used donor ribbon 706 is wound onto a donor ribbon take-up roll 710. The reversing path 726 provides a mechanism to reverse which side of the receiver media 702 that faces the thermal printhead 712.

The printing path 716 includes printing path guides 718 to guide the path of the receiver media 702, as well as main drive rollers 720, printing path and feed rollers 722. Likewise, the reversing path 726 includes reversing path guides 728 and reversing path feed rollers 730. The use of guides and rollers to control the position of receiver media 702 within a printer is well-known in the art and will not be described in further detail here.

In the illustrated embodiment, both the printing path 716 and the reversing path 726 include arc-shaped portions 717 and 727, respectively, to provide "J-shaped" paths. The use of the arc-shaped portions 717 and 727 enable the printer size to be minimized by keeping the paper paths more compact. In some embodiments, one or both of the printing path 716 and the reversing path 726 can include a plurality of arc-shaped portions (for example, forming an "S-shaped" path or a "C-shaped" path) to further reduce the printer size, or to control the location where the printed image exits the printer.

A diverter 732 is pivotable around an axis 733 and can be positioned in either a first diverter position 734, a second diverter position 736 or a third diverter position 738. When the diverter 732 is positioned in the first diverter position 734, the receiver media 702 is directed from the receiver supply roll 704 into the printing path 716. When the diverter 732 is in the second diverter position 736, the receiver media 702 is directed from the receiver supply roll 704 into the reversing path 726. When the diverter 732 is in the third diverter position 738, the receiver media 702 is directed from the reversing path 726 into the printing path 716. In the illustrated embodiment, the diverter 732 has a three-sided cross-section, where the two top sides have a curved profile and the top corner where the two top sides meet is rounded. However, those skilled in the paper handling art will recognize that other diverter shapes can alternately be used to appropriately control the path of the receiver media 702.

A cutter 740 is provided to cut a portion of the receiver media 702 from the receiver supply roll 704. A second cutter 742 is provided to trim the ends of the receiver media 702 after an image has been printed. The cutters 740 and 742 can use type of media cutting mechanism known in the art. In a preferred embodiment, the cutters 740 and 742 use a rotary paper cutter mechanism having a wheel-shaped cutting blade which moves along a rail across the width of receiver media 702. In other embodiments, the cutters 740 and 742 can use other types of media cutting mechanisms, such as guillotine-style cutting blades.

When the printing process is complete, the printed image can be ejected from the duplex thermal printer 700 through an exit 744 using exit rollers 724. Commonly an exit tray (not shown) is provided into which the printed image drops as it passes out of the exit 744.

A printer controller 748 is used to control the operation of the duplex thermal printer 700. The printer controller 748 can include, but is not limited to: a programmable digital computer, a programmable microprocessor, a programmable logic controller, a series of electronic circuits, a series of electronic circuits reduced to the form of an integrated circuit, or a series of discrete components. The printer controller 748 controls the thermal printhead 712 to record images onto the receiver media 702. The printer controller 748 also controls other components such as the various rollers and cutters 740 and 742 shown in FIG. 8. A power supply 746 is used to supply power to the printer controller 748, and to other electrical printer components. The duplex thermal printer 700 also includes a variety of other components that are not shown in FIG. 8, such as the standard components that were described earlier with respect to FIG. 1.

Figure 9:
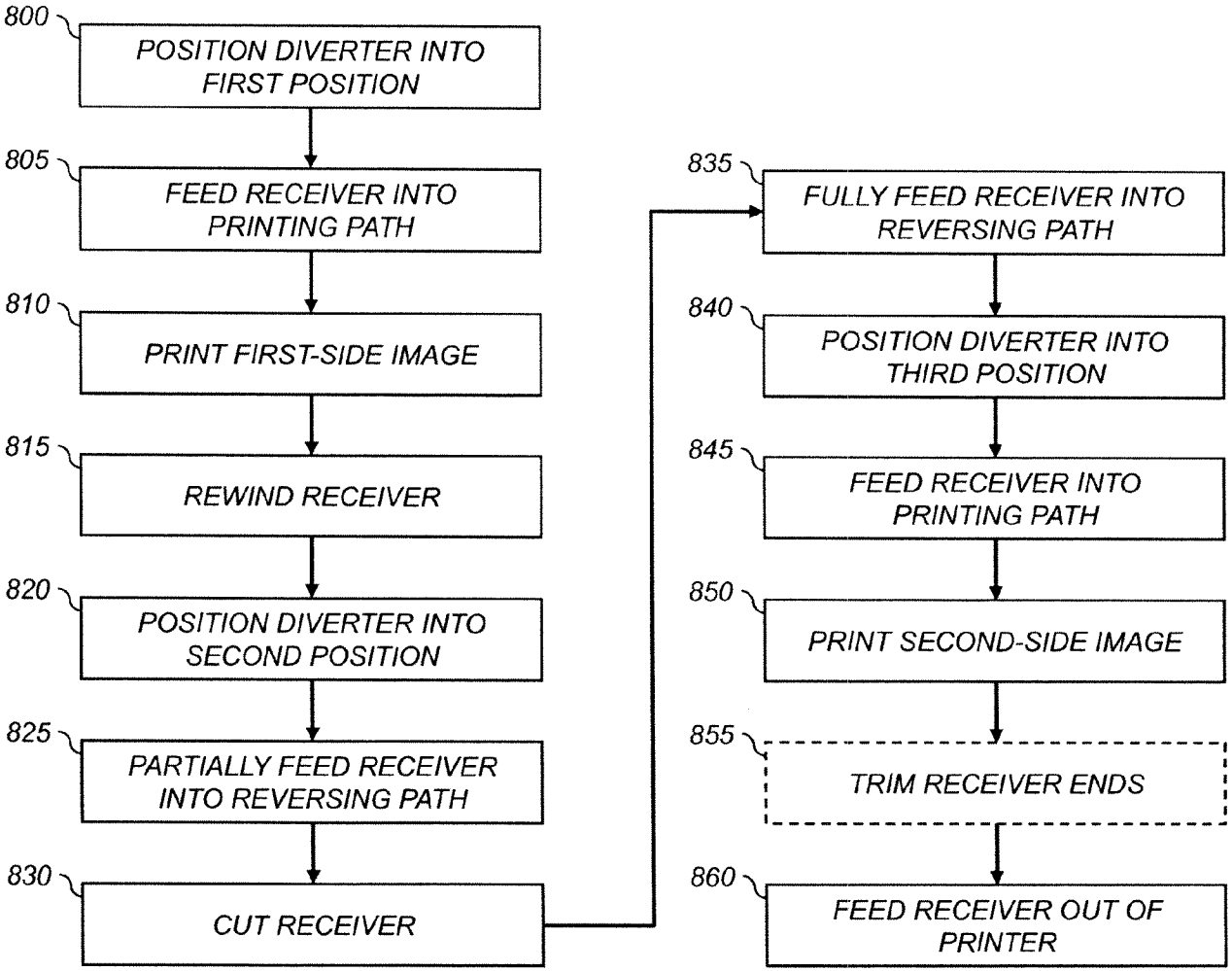
FIG. 9 is a flow diagram showing steps for controlling the duplex thermal printing system of FIG. 8 to provide duplex printing.

FIG. 9 shows a flow diagram summarizing the steps involved with operating the components of the duplex thermal printer 700 of FIG. 8 to provide duplex printing according to a preferred embodiment. FIGS. 10A-10I show a set of accompanying diagrams illustrating the operation of the duplex thermal printer 700 during the duplex printing process.

Figure 10A:
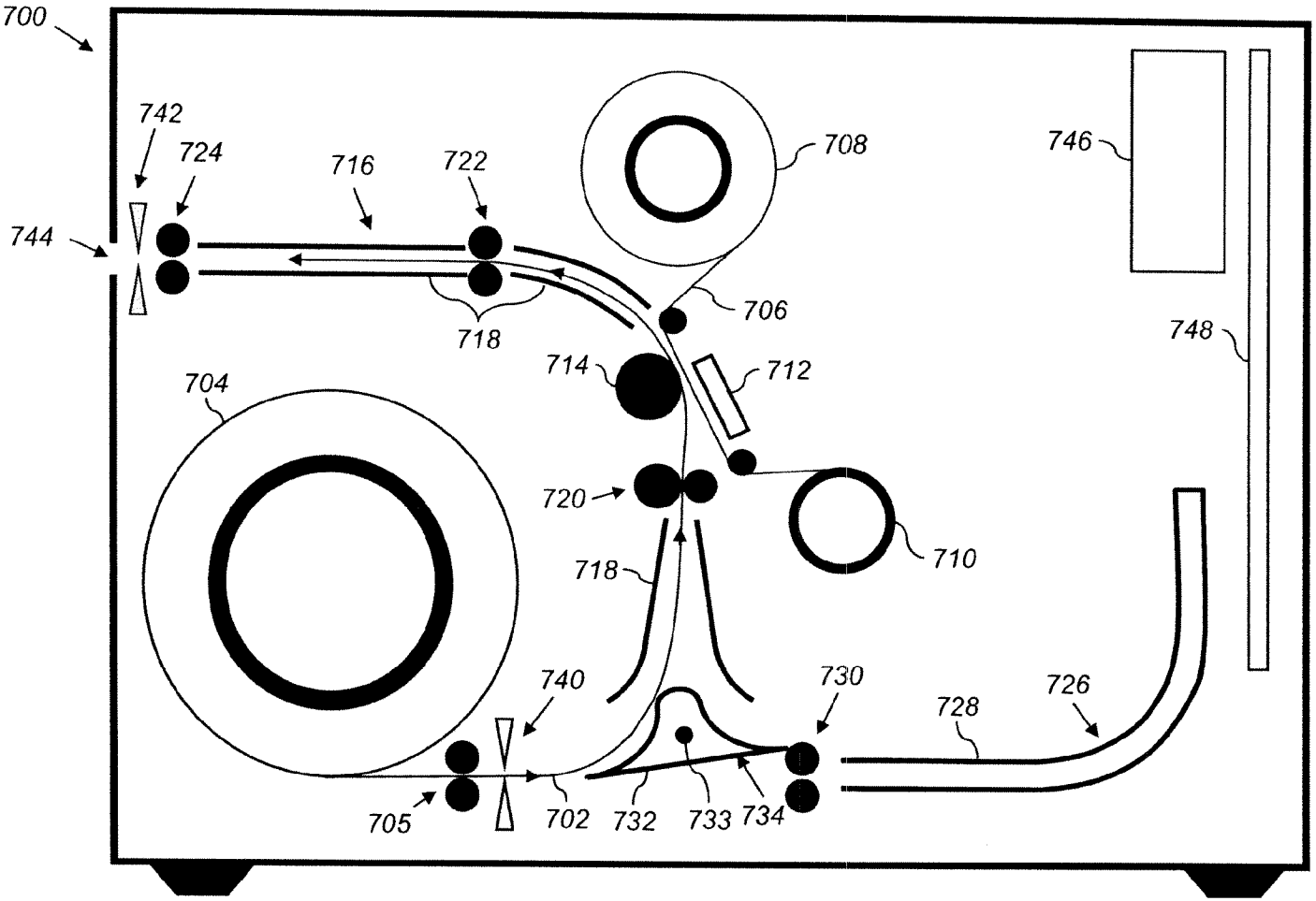
FIGS. 10A-10I show the duplex thermal printing system of FIG. 8 at various stages of a duplex printing process.

A position diverter into first position step 800 is used to position the diverter 732 into the first diverter position 734. In some cases the diverter 732 may already be in the first diverter position 734. In this case, the position diverter into first position step 800 does nothing. In other cases, the diverter 732 may be in another position (e.g., the second diverter position 736 or the third diverter position 738). In this case, the position diverter into first position step 800 pivots the diverter 732 around the axis 733 to reposition it into the first diverter position 734. A feed receiver into printing path step 805 is then used to feed the receiver media 702 from the receiver supply roll 704 into the printing path 716 by activating appropriate drive rollers as shown in FIG. 10A. In this exemplary embodiment, the receiver media 702 is fed into the printing path 716 to the point where the portion of the receiver media 702 that is to receive the printed image is moved past the thermal printhead 712.

Figure 10B:
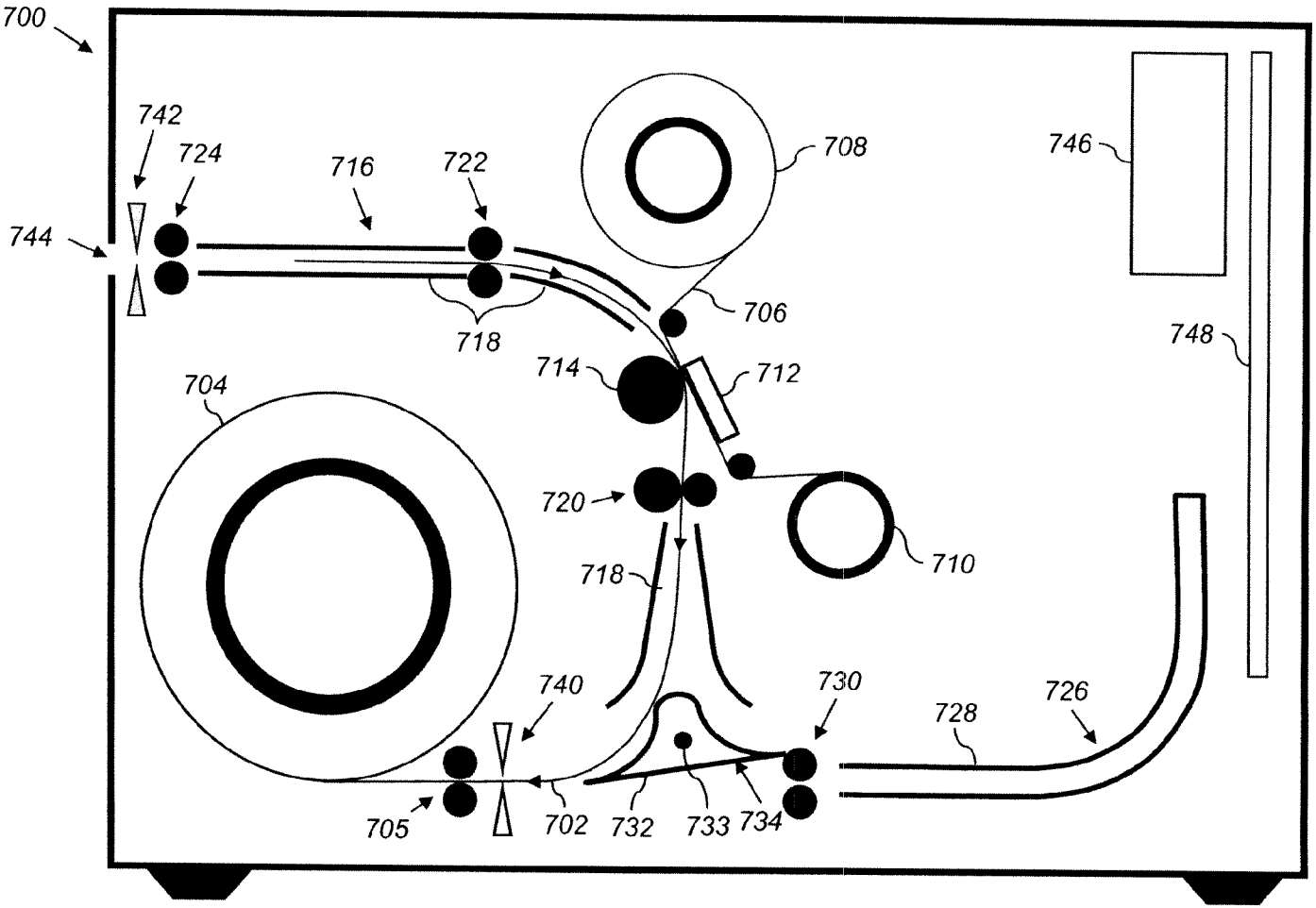

A print first side image step 810 is then used to print a first side image onto a first side of the receiver media 702. This is accomplished by moving the receiver media 702 past the thermal printhead 712, during which time the thermal printhead 712 applies heat pulses to transfer colorant (e.g., dye) from the donor ribbon 706 onto the first side of the receiver media 702 in accordance with image data for the first side image, thereby printing the first-side image. This is illustrated in FIG. 10B. In this exemplary embodiment, the receiver media 702 is wound back onto the receiver supply roll 704 during the print first side image step 810. In other embodiments the receiver media 702 can be moved in the opposite direction during the printing operation.

Commonly, the duplex thermal printer 700 is adapted to print color images. In this case, the donor ribbon 706 typically includes a sequence of donor patches, each having a donor material of a different color as was discussed relative to FIG. 3A. In this case, the print first side image step 810 will generally involve moving the receiver media 702 past the thermal printhead 712 a plurality of times for a plurality of print passes, each time transferring colorant from a donor patch having a different color. Between each of the print passes, the receiver media 702 is repositioned so that the leading edge of the first side image is aligned with the thermal printhead 712. Likewise, the donor ribbon 706 is positioned so that a leading edge of the appropriate donor patch is properly aligned with respect to the thermal printhead 712.

Figure 10C:
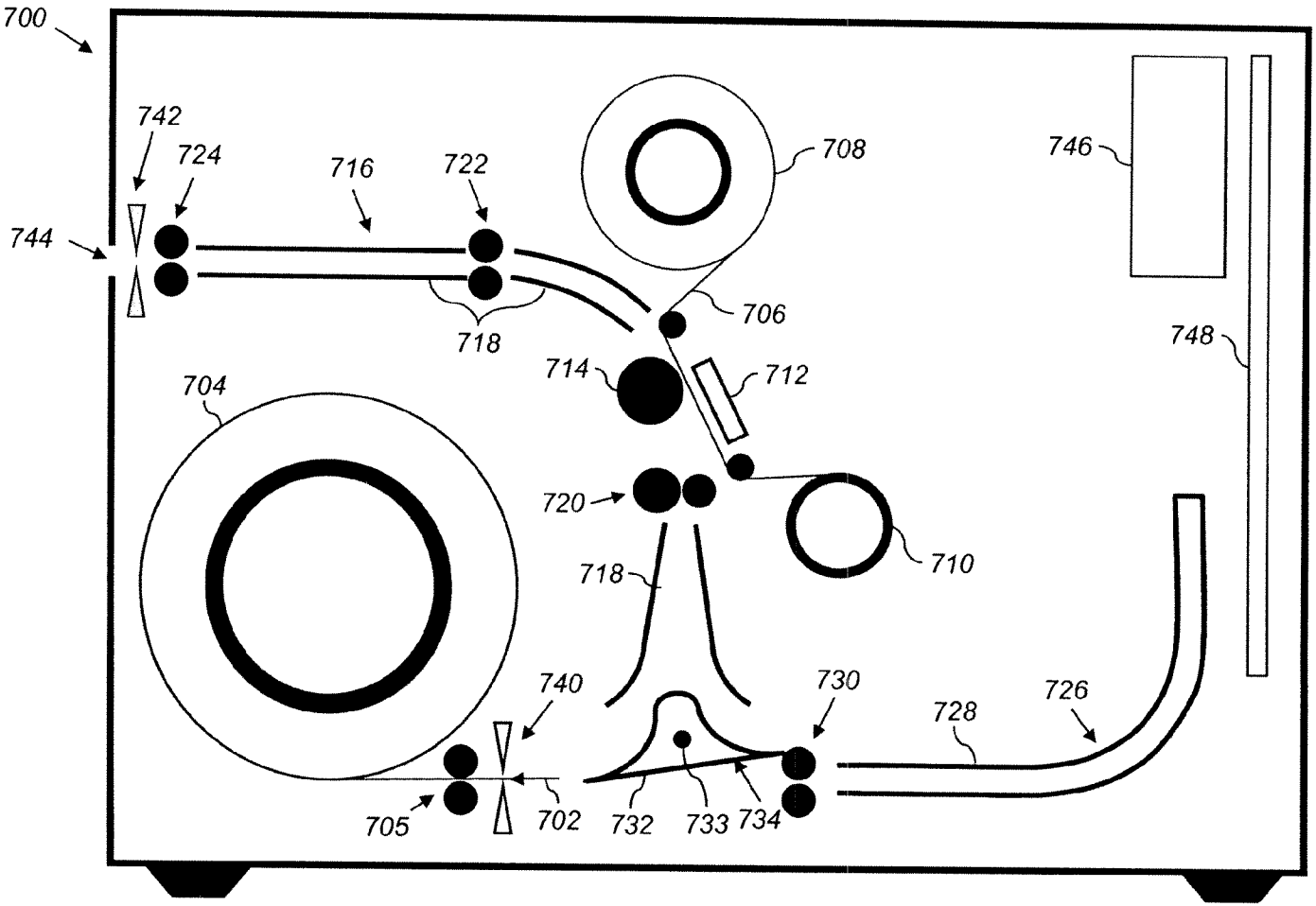

After the first side image has been printed, a rewind receiver step 815 is used to rewind the receiver media 702 back onto the receiver supply roll 704 as illustrated in FIG. 10C. During this step, the receiver media 702 is rewound at least to the point where the leading edge of the receiver media 702 is clear of the diverter 732.

Figure 10D:
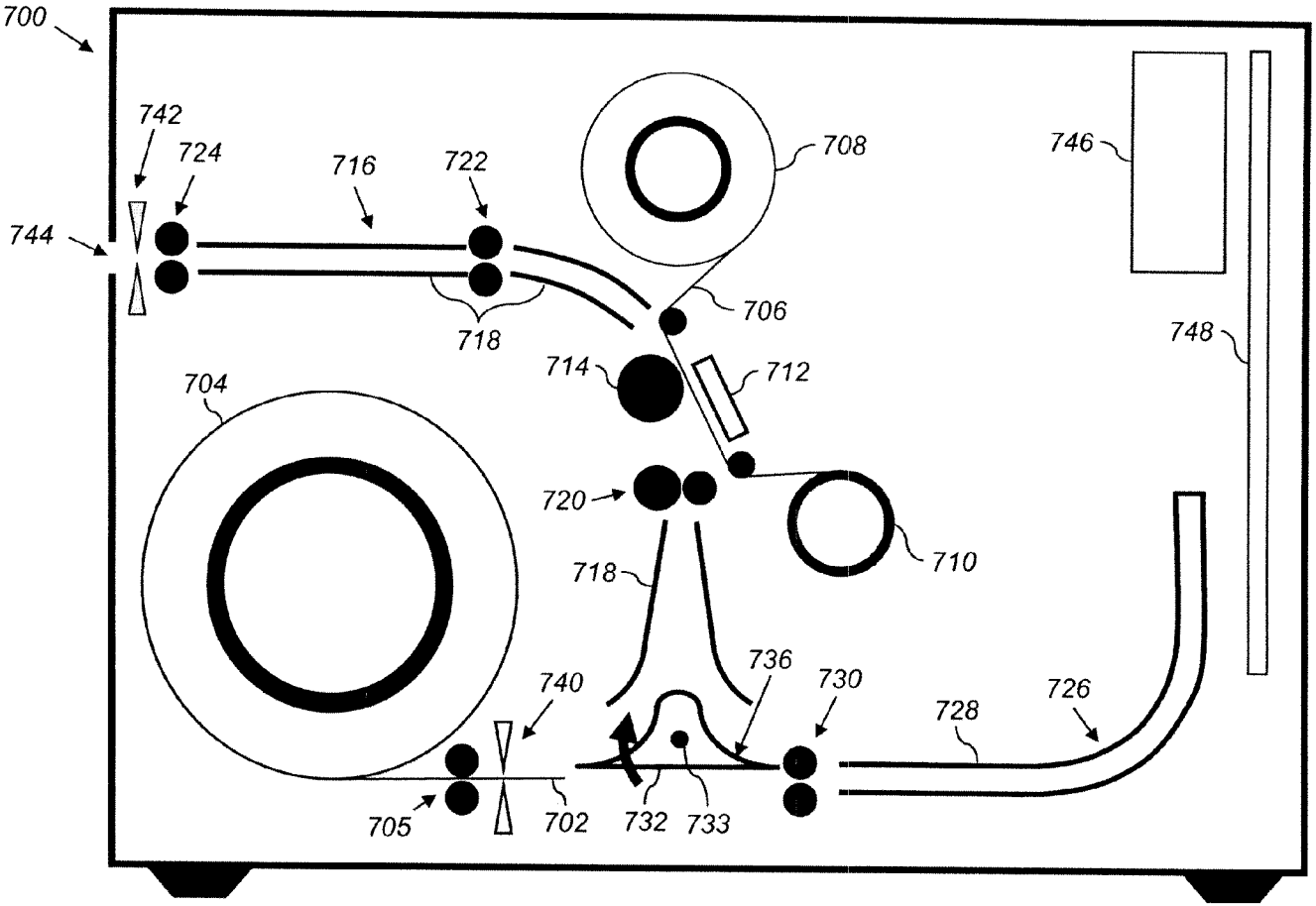
Figure 10E:
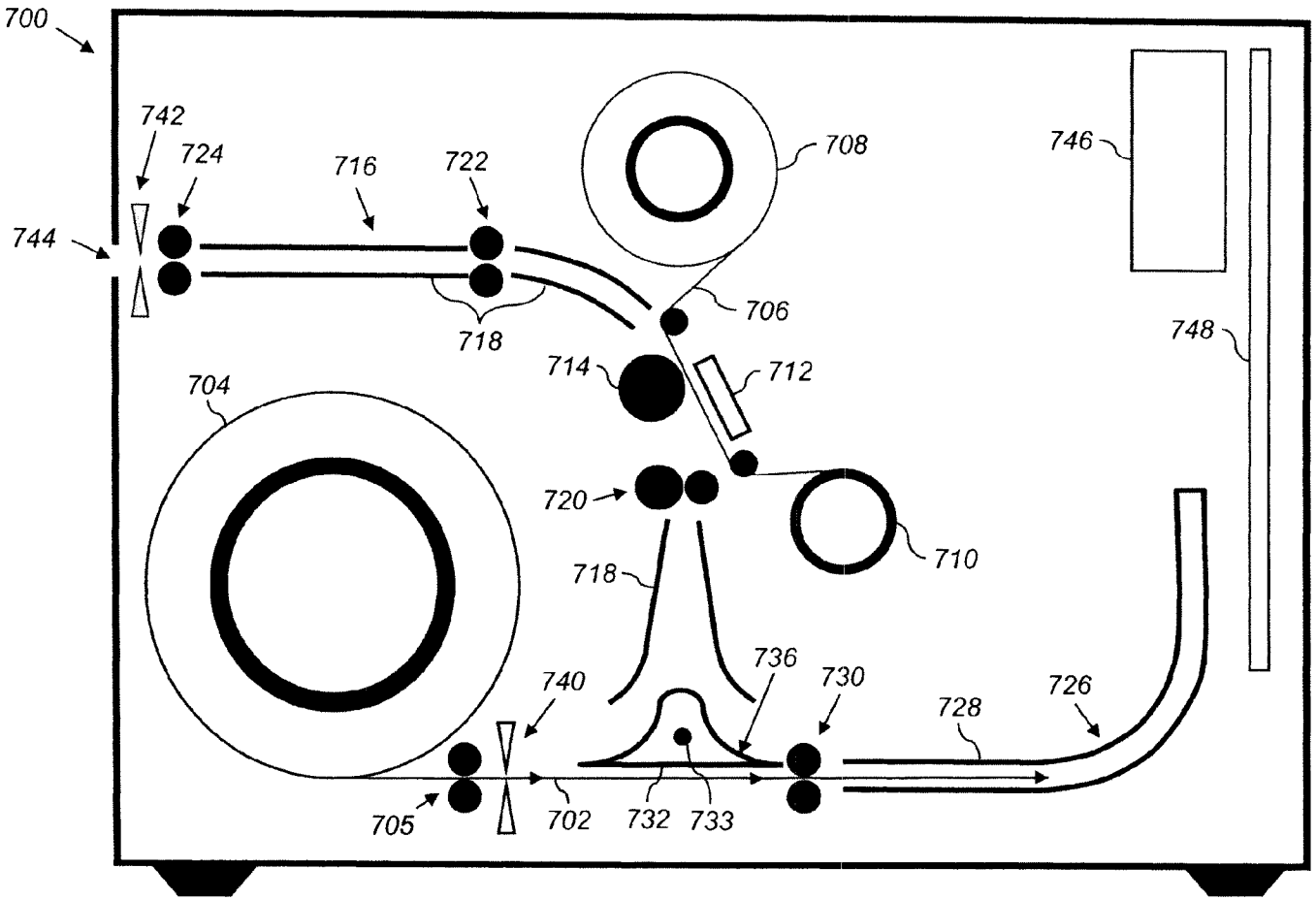

A position diverter into second position step 820 is then used to pivot the diverter 732 around the axis 733 to reposition it into the second diverter position 736 as illustrated in FIG. 10D. The receiver media 702 is then partially fed into the reversing path 726 using a partially feed receiver into reversing path step 825 as shown in FIG. 10E. In a preferred embodiment, the receiver media 702 is advanced to the point where the printed portion of the receiver media 702 is moved past the cutter 740. Since thermal printing systems generally require at least some amount of border be maintained on the leading and trailing edges of the receiver media 702 to adequately hold and control the receiver media 702 during the printing process, the receiver media 702 should be positioned so that the receiver media 702 can be cut with the appropriate border size.

Figure 10F:
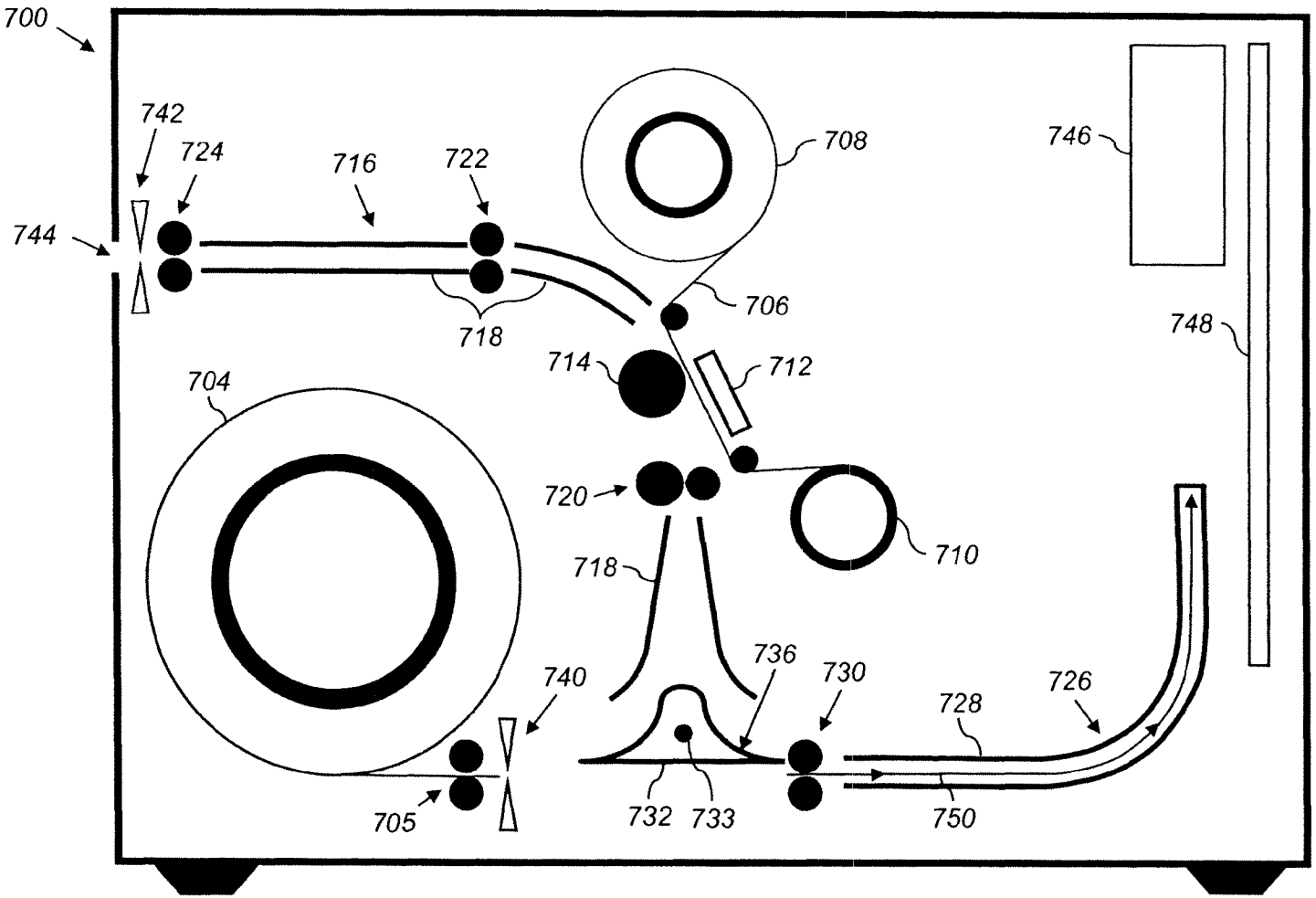

A cut receiver step 830 is then used to cut the receiver media 702 by activating the cutter 740, thereby severing a cut receiver sheet 750 from the receiver supply roll 704. Generally, the receiver media 702 should be stopped before activating the cutter 740. A fully feed receiver into reversing path step 835 is then used to feed the cut receiver sheet 750 fully into the reversing path 726 as shown in FIG. 10F.

Figure 10G:
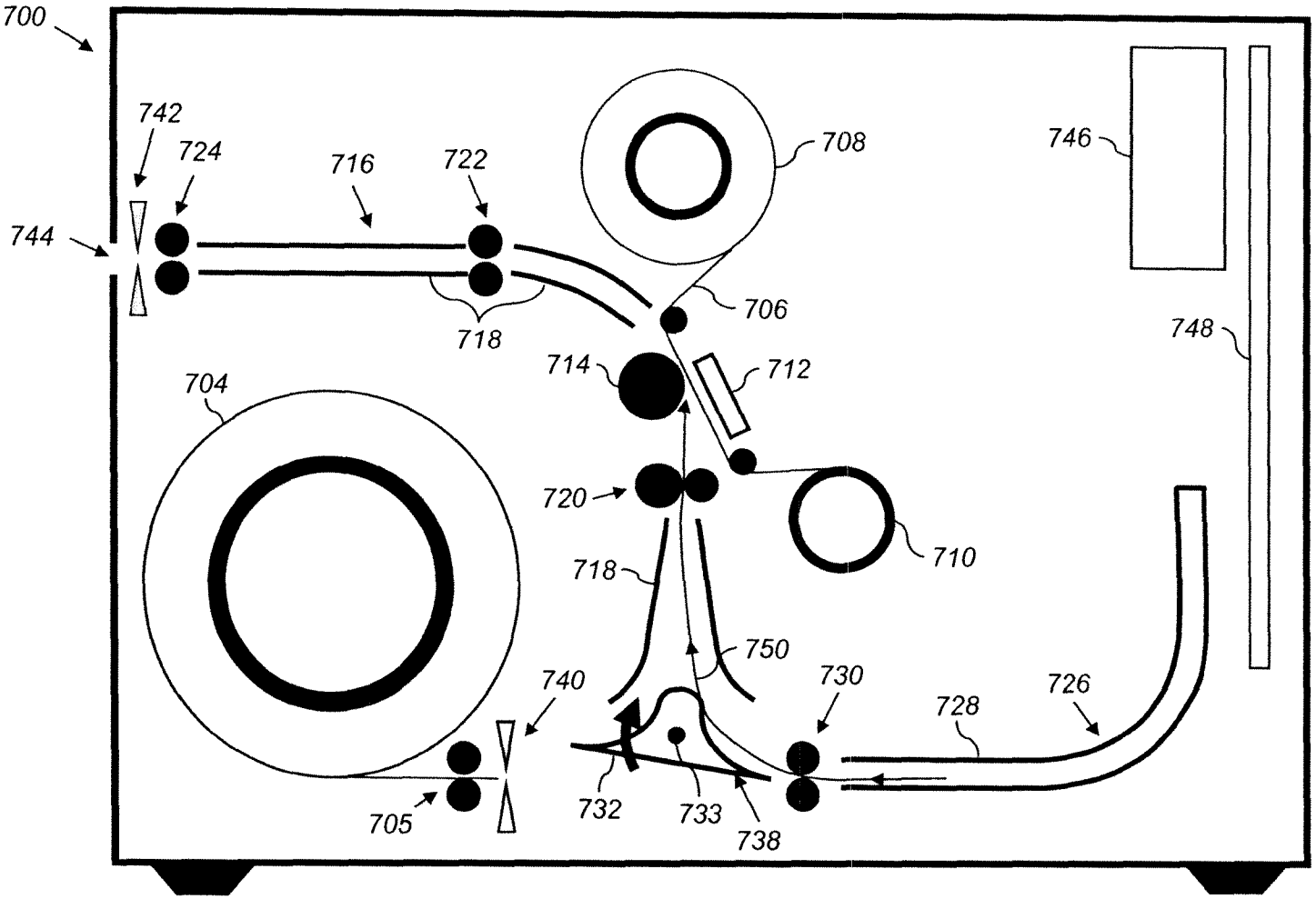

Next, a position diverter into third position step 840 is used to pivot the diverter 732 around the axis 733 to reposition it into the third diverter position 738 as shown in FIG. 10G. A feed receiver into printing path step 845 then feeds the cut receiver sheet 750 into the printing path 716. By performing this series of operations, the second side of the cut receiver sheet 750 is now oriented to face the thermal printhead 712, thereby enabling a second side image to be printed.

Figure 10H:
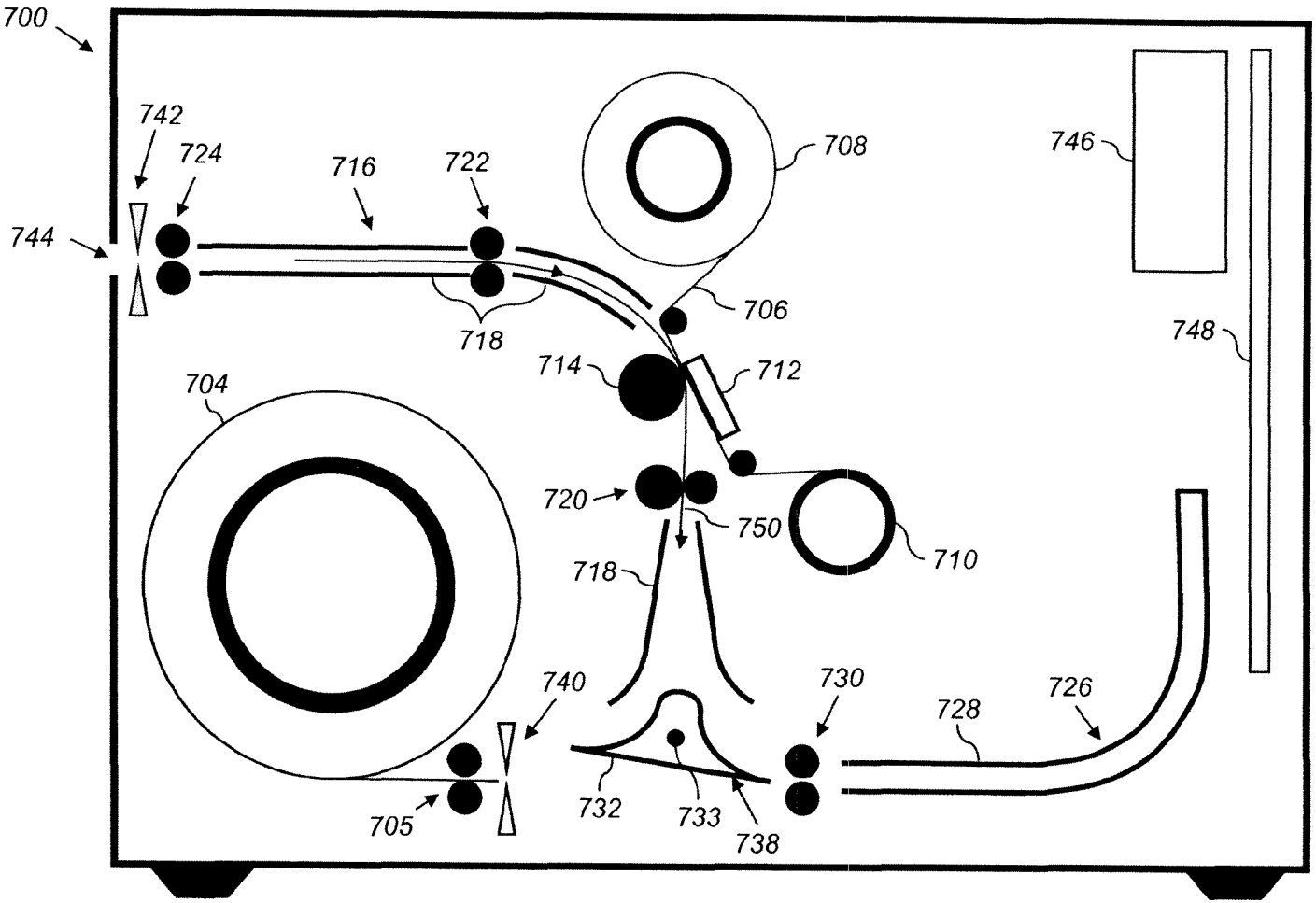

A print second side image step 850 is then used to print the second side image onto the second side of the cut receiver sheet 750. This is accomplished by moving the cut receiver sheet 750 past the thermal printhead 712, during which time the thermal printhead 712 applies heat pulses to transfer colorant (e.g., dye) from the donor ribbon 706 onto the second side of the cut receiver sheet 750 in accordance with image data for the second side image, thereby printing the second-side image. This is illustrated in FIG. 10H. As was discussed relative to the print first side image step 810, the print second side image step 850 may involve a plurality of print passes to print color images using a plurality of different colorants. In this exemplary embodiment, the cut receiver sheet 750 is moved in a downward direction during the print second side image step 850. In other embodiments the cut receiver sheet 750 can be moved in the opposite direction during the printing operation.

As mentioned earlier, it is typically necessary to maintain at least some amount of border on the leading and trailing edges of the cut receiver sheet 750 during the printing process. For many applications, it is desirable that the final printed image provided to the user by the duplex thermal printer 700 be a borderless print. Therefore, an optional trim receiver ends step 855 can be used to trim one or more ends off of the cut receiver sheet 750.

Figure 10I:
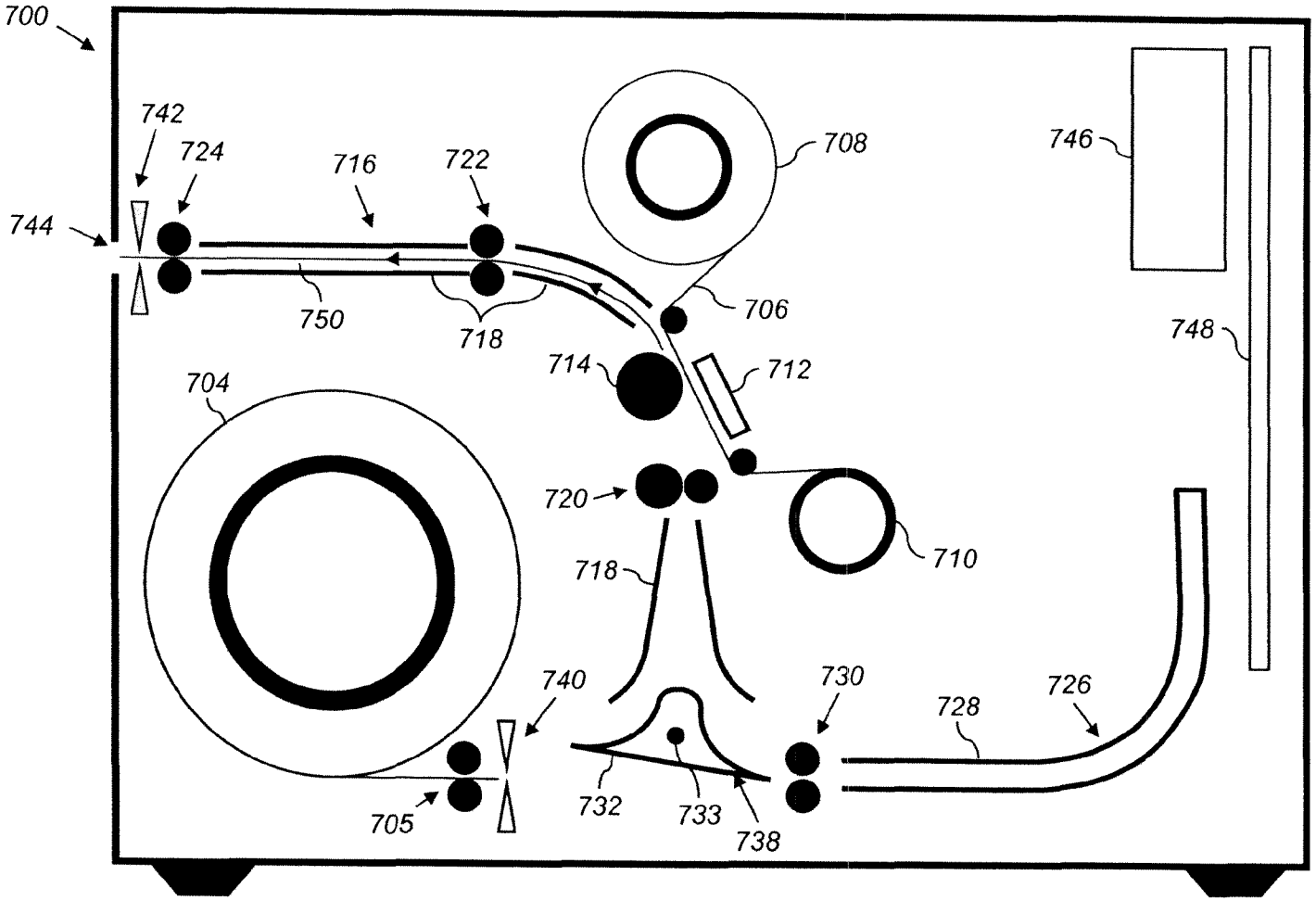

In the illustrated embodiment, the cut receiver sheet 750 is fed toward the exit 744 until the first end portion to be trimmed off extends beyond the cutter 742 as shown in FIG. 10I. The movement of the cut receiver sheet 750 is then paused and the cutter 742 is activated to cut off the first end portion of the cut receiver sheet 750. In a preferred embodiment, a waste bin (not shown) is provided into which the first end portion will fall when it is cut off. The waste bin can be emptied periodically by an operator.

The cut receiver sheet 750 is then advanced further until the printed portion of the cut receiver sheet 750 (i.e., the portion of the cut receiver sheet 750 to be kept) extends beyond the cutter 742. The movement of the cut receiver sheet 750 is then paused and the cutter 742 is activated to cut off the second end portion of the cut receiver sheet 750. The second end portion can then be allowed to fall into the waste bin.

A feed receiver out of printer step 860 is then used to feed the cut receiver sheet 750 out of the duplex thermal printer 700, where it can be provided to the customer, or can be passed onto other finishing operations (such as a binding operation to form a photo book with including a plurality of printed pages). In some embodiments, the cut receiver sheet 750 may be extended out of the exit 744 a substantial distance at the time that the trim receiver ends step 855 trims the second end portion of the cut receiver sheet 750. In this case, the cut receiver sheet 750 can simply be allowed to fall into an output tray (not shown). In other cases, the cut receiver sheet 750 may be fed out of the duplex thermal printer 700 using feed rollers.

Figure 11:
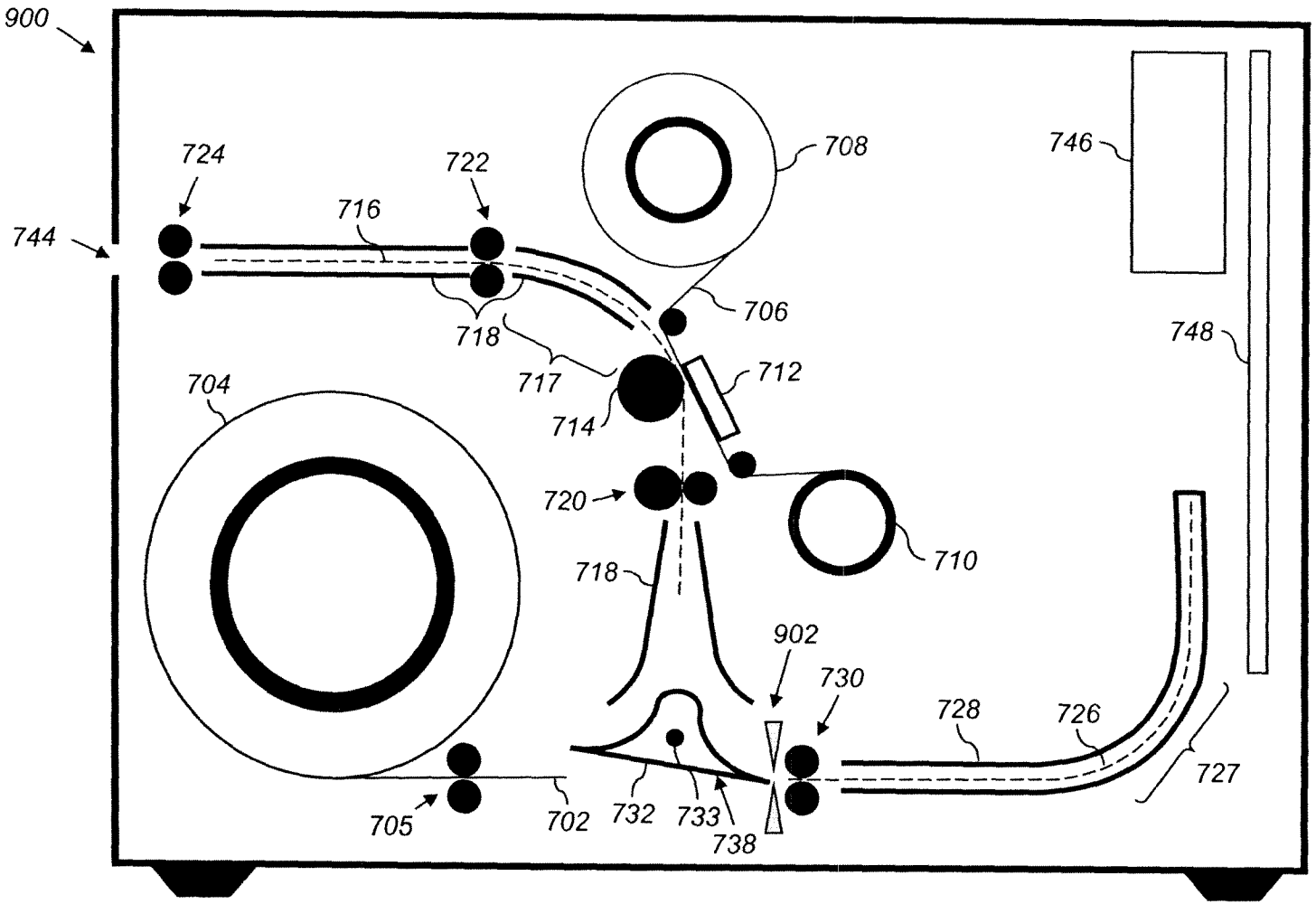
FIG. 11 is a diagram illustrating a duplex thermal printing system according to an alternate embodiment.

Those skilled in the art will recognize that many variations of the exemplary embodiment discussed relative to FIGS. 8-9 and 10A-10I can be made within the spirit and scope of the present invention. For example, FIG. 11 shows an alternate embodiment of a duplex thermal printer 900, which is identical to the duplex thermal printer 700 of FIG. 8 except that the cutters 740 and 742 have been replaced with a single cutter 902.

The operation of the duplex thermal printer 900 is analogous to that which was described relative to the flow diagram of FIG. 9 for the duplex thermal printer 700. The main differences relate to the positioning of the receiver media 702 for the cutting operations.

For the cut receiver step 830, the receiver media 702 needs to be fed further into the reversing path 726 before it is cut. After the cut receiver sheet 750 has been cut off, the remaining uncut portion of the receiver media 702 should then be wound back onto the receiver supply roll 707 until it clears the diverter 732 before it can be moved back into the first diverter position 734.

The cutter 902 is also used to perform the trim receiver ends step 855. After the second side image has been printed, the cut receiver sheet 750 is directed back into the reversing path 726 until the first end portion to be trimmed off extends beyond the cutter 902, at which point the cutter 902 is activated to cut off the first end portion of the cut receiver sheet 750. The cut receiver sheet 750 is then advanced further until the printed portion of the cut receiver sheet 750 (i.e., the portion of the cut receiver sheet 750 to be kept) extends beyond the cutter 902, at which point the cutter 902 is activated again to cut off the second end portion of the cut receiver sheet 750. The cut receiver sheet 750 can then be fed back through the printing path 716 and out the exit 744.

The configuration of the duplex thermal printer 900 of FIG. 11 provides a cost advantage relative to the duplex thermal printer 700 of FIG. 8 due to the need for one less cutter mechanism. However, it will generally be slightly disadvantaged for print speed due to the extra distance that the cut receiver sheet 750 must travel during the process of trimming the ends. In an alternate embodiment, the exit 744 can be repositioned to the end of the reversing path 726 to minimize the distance that the cut receiver sheet must travel after the trimming process is completed.

One skilled in the art will recognize that numerous other variations of the described embodiments can be made within the scope of the present invention. FIG. 13 shows an embodiment of a duplex thermal printer 905 that includes several optional features. One problem that can occur with roll-fed receiver media is curl that is introduced by the media being stored on the receiver supply roll 704. To reduce the amount of media curl, the receiver supply roll 704 can be turned so that the receiver media 702 feeds off the receiver supply roll 704 when it is turned in a clockwise direction. The receiver media 702 can then be pulled around a receiver decurling roller 910 in an orientation that counteracts the curl that was introduced by the receiver media 702 being wound around the receiver supply roll 704, thereby relieving some or all of the curl. Guides 915 can be used to guide the receiver media 702 around the receiver decurling roller 910 and into the supply feed rollers 705.

Figure 12:
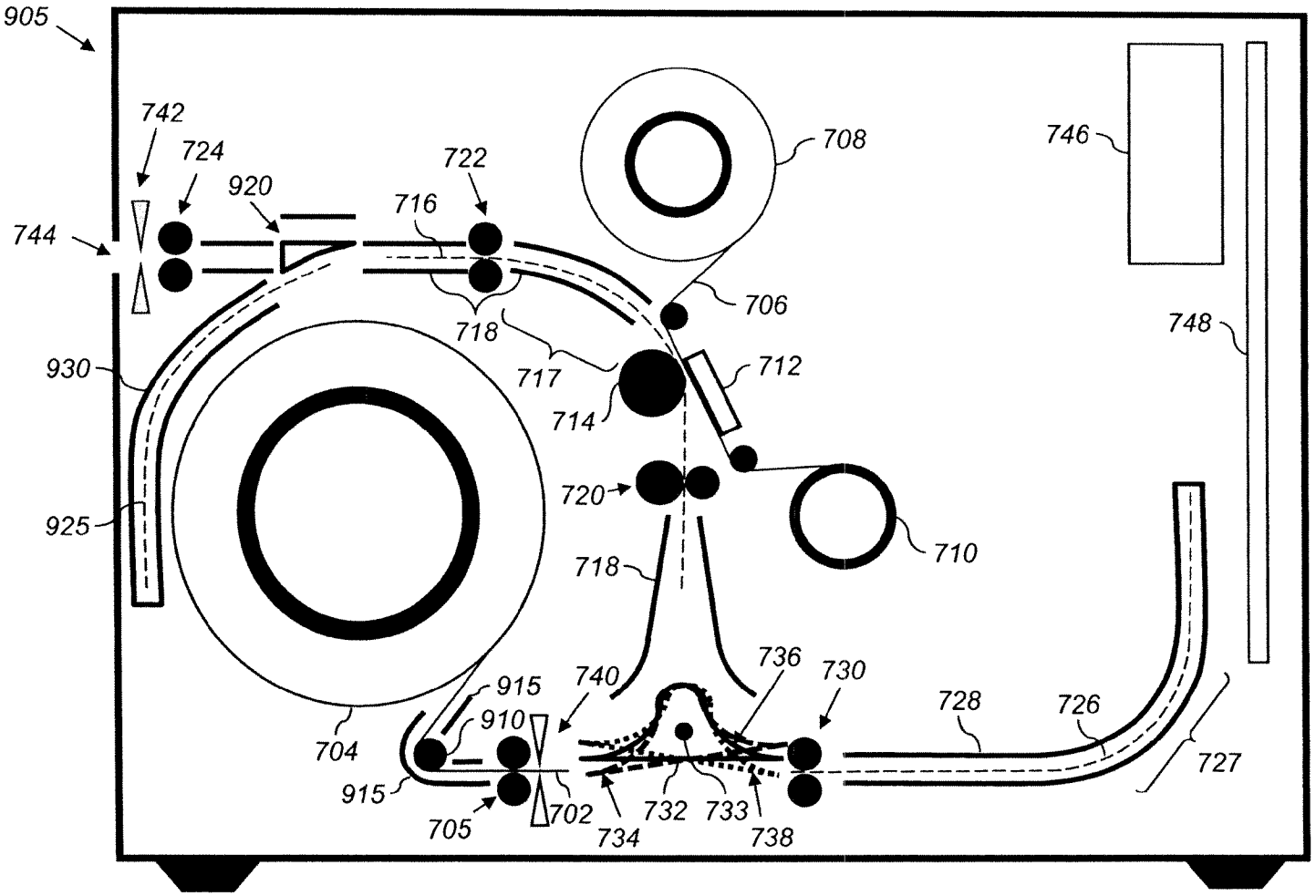
FIG. 12 is a diagram illustrating a duplex thermal printing system including several optional features.

The configurations shown in FIG. 8 and FIG. 12 have the characteristic that the receiver media 702 may extend partially out of the printer through the exit 744 during each printing pass. This increases the risk of contamination of the receiver media 702 due to dust and dirt being introduced from the external environment. Furthermore, it can be confusing to the user when the see the partially printed image coming out of the exit 744. To mitigate these disadvantages, an upper diverter 920 can be used to divert the receiver media 702 into an internal path 925 with internal path guides 930. The upper diverter 920 is positioned in a first raised position during the printing passes to direct the receiver media 702 into the internal path 925. Then, when printing has been completed, the upper diverter 920 can be repositioned to a second lowered position, direction the receiver media 702 toward the exit 744. In this way, the receiver media 744 never leaves the duplex thermal printer 905 until the printing process is complete.

In the illustrated embodiments of FIGS. 8, 11 and 12, the diverter 732 has a three-sided cross-section, where the two top sides have a curved profile and the top corner where the two top sides meet is rounded. It will be obvious to one skilled in the art that a variety of diverter configurations can be used to perform the desired function. FIGS. 13A-13F illustrate a set of exemplary diverter configurations that can be used in accordance with the present invention. FIG. 13A shows the same diverter 732 illustrated in FIGS. 8, 11 and 12. FIG. 13B illustrates a similar configuration of a diverter 732 where the top corner where the two top sides meet is not rounded. FIG. 13C illustrates a configuration of a diverter 732 having a simple triangular cross-section with flat sides. FIG. 13D illustrates a configuration similar to FIG. 13A where rollers 760 are added at the three corners of the three-sided shape, and the sides of the diverter 732 are provided as guides 762 are used to direct the receiver media 26 (FIG. 8). The rollers 760 provide the advantage that there will be a lower amount of friction between the receiver media 26 and the diverter 732. The rollers 760 can either be passive or driven. FIG. 13E illustrates an alternate configuration where the diverter 732 includes a belt 764 that follows a belt path around three rollers 760. The belt can be driven in a clockwise or counter-clockwise direction in accordance with the direction that the receiver media 26 is being moved past the diverter 732. In some embodiments, the belt 764 can be a vacuum belt, which is well-known in the art. FIG. 13F illustrates an alternate configuration where the diverter 732 includes a paddle 736 that can be pivoted into three positions. In the first diverter position 734, the right side of the paddle 766 is tilted up to deflect the receiver media 26 from the receiver supply roller 704 (FIG. 8) toward the printing path 716 toward the printing path 716 (FIG. 8). In the second diverter position 736, the paddle 766 is rotated into a horizontal position so that the receiver media 26 can pass underneath in an undeflected path. In the third diverter position 738, the left side of the paddle 766 is tilted up to deflect the receiver media 26 from the reversing path 726 (FIG. 8) toward the printing path 716. FIG. 13G illustrates a similar configuration where the paddle 766 has a curved profile.

The invention has been described in detail with particular reference to certain preferred embodiments thereof, but it will be understood that variations and modifications can be effected within the spirit and scope of the invention.

PARTS LIST

18 thermal printer
20 printer controller
22 thermal printhead
22A thermal printhead
22B thermal printhead
26 receiver media
30 donor ribbon
30A donor ribbon
30B donor ribbon
32.1 donor patch set
32.2 donor patch set
34.1 yellow donor patch
34.2 yellow donor patch
36.1 magenta donor patch
36.2 magenta donor patch
38.1 cyan donor patch
38.2 cyan donor patch
40.1 clear donor patch
40.2 clear donor patch
42 receiver drive roller
43 thermal resistors
44 receiver supply roll
45 ceramic substrate
46 platen roller
47 heat sink
48 donor ribbon take-up roll
50 donor ribbon supply roll
52 image receiving area
54 peel member
56 idler roller
62 user input system
64 output system
68 memory
71 removable memory interface
72 hard drive
74 communication system
76 remote memory
80 sensor system
82 donor position sensor
84 receiver position sensor
86 movement sensor
88 follower wheel
90 heat sink
92 peel member
94 pinch roller
96 micro-grip roller
400 thermal printing system
410 duplex thermal printing system
420 duplex thermal printing system
422 first position
424 second position
430 duplex thermal printing system
432 cutter
433 cut receiver media
434 diverter
435 first position
436 second position
438 turn roller
439 guides
700 duplex thermal printer
702 receiver media
704 receiver supply roll
705 supply feed rollers
706 donor ribbon
708 donor ribbon supply roll
710 donor ribbon take-up roll
712 thermal printhead
714 platen roller
716 printing path
717 arc-shaped portion
718 printing path guides
720 main drive rollers
722 printing path feed rollers
724 exit rollers
726 reversing path
727 arc-shaped portion
728 reversing path guides
730 reversing path feed rollers
732 diverter
733 axis
734 first diverter position
736 second diverter position
738 third diverter position
740 cutter
742 cutter
744 exit
746 power supply

748 printer controller
750 cut receiver sheet
760 roller
762 guide
764 belt
766 paddle
800 position diverter into first position step
805 feed receiver into printing path step
810 print first-side image step
815 rewind receiver step
820 position diverter into second position step
825 partially feed receiver into reversing path step
830 cut receiver step
835 fully feed receiver into reversing path step
840 position diverter into third position step
845 feed receiver into printing path step
850 print second-side image step
855 trim receiver ends step
860 feed receiver out of printer step
900 duplex thermal printer
902 cutter
905 duplex thermal printer
910 receiver decurling roller
915 guides
920 upper diverter
925 internal path
930 internal path guides
L patch set leading edge
LED donor patch leading edge
LER receiving area leading edge
T patch set trailing edge
TER receiving area trailing edge

The invention claimed is:

1. A roll-fed duplex thermal printing system, comprising:
a supply roll of thermal imaging receiver having dye receiving layers on first and second sides of a substrate;
a printing path;
a reversing path;
a diverter pivotable around an axis into a first position, a second position and a third position, wherein when the diverter is in the first position thermal imaging receiver is directed from the supply roll into the printing path, when the diverter is in the second position the thermal imaging receiver is directed from the supply roll into the reversing path, and when the diverter is in the third position the thermal imaging receiver is directed from the reversing path into the printing path;
a thermal printhead positioned along the printing path;
a donor ribbon feeding from a donor supply roll past the thermal printhead to a donor take-up roll;
a cutter positioned between the diverter and the reversing path; and
a printer controller that controls components of the thermal printing system to perform the following sequence of operations:
positioning the diverter into the first position;
feeding the thermal imaging receiver from the supply roll into the printing path such that the first side of the thermal imaging receiver is oriented to face the thermal printhead;
moving the thermal imaging receiver and the donor ribbon past the thermal printhead, during which time the thermal printhead applies heat pulses to transfer colorant from the donor ribbon onto the first side of the thermal imaging receiver, thereby printing a first-side image;
winding the thermal imaging receiver back onto the supply roll;
pivoting the diverter around the axis to reposition it into the second position;
feeding the thermal imaging receiver from the supply roll into the reversing path;
using the cutter to cut a portion of the thermal imaging receiver including the printed first-side image from the supply roll;
winding the uncut portion of the thermal imaging receiver back onto the supply roll;
pivoting the diverter around the axis to reposition it into the third position;
feeding the cut thermal imaging receiver into the printing path such that the second side of the thermal imaging receiver is oriented to face the thermal printhead;
moving the cut thermal imaging receiver and the donor ribbon past the thermal printhead, during which time the thermal printhead applies heat pulses to transfer colorant from a donor ribbon onto the second side of the thermal imaging receiver, thereby printing a second-side image; and
feeding the cut thermal imaging receiver out of the printing system.

2. The roll-fed duplex thermal printing system of claim 1 wherein one or both of the printing path and the reversing path includes an arc-shaped portion.

3. The roll-fed duplex thermal printing system of claim 1 wherein the printing system is a color printing system, and wherein the thermal imaging receiver is moved past the thermal printhead a plurality of times while printing one or both of the first-side image and the second-side image to transfer a plurality of donor materials from a corresponding plurality of donor patches positioned sequentially on the donor ribbon, the donor materials including a corresponding plurality of different colorants.

4. The roll-fed duplex thermal printing system of claim 3 wherein the donor patches include a clear donor patch for applying a donor material that provides a protective coating over the printed colorants.

5. The roll-fed duplex thermal printing system of claim 1 further including using the cutter to trim at least one end of the cut thermal imaging receiver after printing the second side image.

6. The roll-fed duplex thermal printing system of claim 1 wherein the diverter has a three-sided cross-section.

7. The roll-fed duplex thermal printing system of claim 6 wherein one or more of the sides have a curved profile.

8. The roll-fed duplex thermal printing system of claim 1 wherein the printing path includes guides for guiding the receiver media through the printing path and feed rollers for feeding the receiver media through the printing path.

9. The roll-fed duplex thermal printing system of claim 1 wherein the reversing path includes guides for guiding the receiver media through the reversing path and feed rollers for feeding the receiver media through the reversing path.

10. The roll-fed duplex thermal printing system of claim 1 wherein the cut thermal imaging receiver is fed out of the printing system through an exit at the end of the printing path or through an exit at the end of the reversing path.

11. The roll-fed duplex thermal printing system of claim 1 further including a receiver decurling roller, wherein the thermal imaging receiver is pulled around the receiver decurling roller in an orientation that counteracts a curl of the thermal imaging receiver introduced by the thermal imaging receiver being wound around the supply roll.

12. The roll-fed duplex thermal printing system of claim 1 further including a second diverter positioned between the thermal printhead and an exit at the end of the printing path, the second diverter having a first position and a second position, wherein when the second diverter is in the first position the thermal imaging receiver is directed from the printing path into an internal media path, and when the second diverter is in the second position the thermal imaging receiver is directed out of the printing system through the exit at the end of the printing path.

13. The roll-fed duplex thermal printing system of claim 1 wherein the diverter includes a belt wrapped around a plurality of rollers.

14. The roll-fed duplex thermal printing system of claim 13 wherein the belt is a vacuum belt.

15. The roll-fed duplex thermal printing system of claim 1 wherein the diverter includes pivotable paddle.

* * * * *